US011340041B2

(12) United States Patent
Salamon, III et al.

(10) Patent No.: US 11,340,041 B2
(45) Date of Patent: May 24, 2022

(54) TRITIUM FIBER IRON SIGHT

(71) Applicant: Trijicon, Inc., Wixom, MI (US)

(72) Inventors: Edward J. Salamon, III, Chelsea, MI (US); Richard James Lichon, Gaines, MI (US); Nicole Renee Thornton, White Lake, MI (US)

(73) Assignee: Trijicon, Inc., Wixom, MI (US)

( * ) Notice: Subject to any disclaimer, the term of this patent is extended or adjusted under 35 U.S.C. 154(b) by 59 days.

(21) Appl. No.: 16/938,276

(22) Filed: Jul. 24, 2020

(65) Prior Publication Data

US 2022/0026176 A1 Jan. 27, 2022

(51) Int. Cl.
*F41G 1/34* (2006.01)
*F41G 1/10* (2006.01)

(52) U.S. Cl.
CPC ..... *F41G 1/345* (2013.01); *F41G 1/10* (2013.01)

(58) Field of Classification Search
CPC ..... F41G 1/345; F41G 1/10; F41G 1/02
See application file for complete search history.

(56) References Cited

U.S. PATENT DOCUMENTS 5,065,519 A * 11/1991 Bindon ..... F41G 1/32 42/145
5,070,619 A * 12/1991 Santiago ..... F41G 1/425 42/144
5,836,100 A 11/1998 Stover
5,930,906 A 8/1999 Howe et al.
5,956,854 A 9/1999 Lorocco
6,122,833 A 9/2000 Lorocco
6,216,352 B1 4/2001 Lorocco
6,360,472 B1 3/2002 Lorocco
D492,747 S 7/2004 LoRocco
7,562,486 B2 * 7/2009 LoRocco ..... F41G 1/345 42/132
7,627,976 B1 * 12/2009 Olson ..... F41G 1/345 42/132
7,908,783 B2 3/2011 Howe et al.
8,230,637 B2 7/2012 Lamb
8,635,801 B2 * 1/2014 Glimpse ..... F41G 1/32 42/132
8,656,631 B2 * 2/2014 Koesler ..... F41G 1/027 42/132
8,813,413 B2 8/2014 Howe et al.
8,925,237 B2 * 1/2015 Howe ..... F41G 1/345 42/132
9,335,118 B1 5/2016 Jackson
9,335,165 B2 * 5/2016 Profos ..... G01C 3/00
9,587,910 B1 3/2017 Jackson
(Continued)

*Primary Examiner* — Joshua T Semick
(74) *Attorney, Agent, or Firm* — Harness, Dickey & Pierce, P.L.C.

(57) ABSTRACT

A sight for a firearm includes a housing, a tritium light source, a light transmission rod, and a retainer. The housing is configured to be mounted to a firearm. The tritium light source is supported within the housing. The light transmission rod is disposed in a cavity of the housing and positioned adjacent the tritium light source. The light transmission rod is configured to collect and transmit both an ambient light and a light from the tritium light source. The retainer is removably engaged with the housing and fixes the light transmission rod within the cavity. Removal of the retainer provides access for replacement of the light transmission rod.

20 Claims, 13 Drawing Sheets

(56) References Cited

U.S. PATENT DOCUMENTS

| | | | | |
|---|---|---|---|---|
| 9,869,525 | B1 | 1/2018 | Howe et al. | |
| 9,909,838 | B1 | 3/2018 | Jackson | |
| 10,062,464 | B2 * | 8/2018 | Karchon | G21F 5/015 |
| 10,088,274 | B2 * | 10/2018 | Howe | F41G 1/345 |
| 10,088,275 | B1 | 10/2018 | Warren | |
| 10,180,306 | B2 | 1/2019 | Ben Zion et al. | |
| 10,274,285 | B2 | 4/2019 | Howe et al. | |
| 10,480,899 | B1 * | 11/2019 | Karchon | F41G 1/027 |
| 10,495,408 | B2 | 12/2019 | Moore | |
| 10,724,569 | B2 * | 7/2020 | Windfeldt | F16B 21/02 |
| 10,760,877 | B2 * | 9/2020 | Howe | F41G 1/01 |
| 2006/0123687 | A1 * | 6/2006 | Howe | F41G 1/345 42/145 |
| 2011/0107650 | A1 | 5/2011 | Howe et al. | |
| 2014/0317989 | A1 | 10/2014 | Lee | |
| 2017/0219313 | A1 | 8/2017 | Howe et al. | |

* cited by examiner

TRITIUM FIBER IRON SIGHT

FIELD

The present disclosure relates to a sighting device for firearms or other projectile launching devices and, more particularly, to a self-illuminated sight device having both a replaceable light collector and an artificial light source.

BACKGROUND

This section provides background information related to the present disclosure which is not necessarily prior art.

Sighting devices for firearms, archery bows, or other projectile launching devices often use segments of fiber optics to gather ambient light along their length and transmit the light from their ends. Under ideal lighting conditions, one end of the fiber optic serves as a bright aiming point. For use in low light conditions, some sighting devices include an artificial light source, such as an LED or tritium light source, to provide light to the fiber optic.

It has been found that the fiber optics used in some sighting devices have a limited life. For example, damage to the fiber may render the product inferior. When the fiber optic has become damaged, the sighting device may need to be replaced.

SUMMARY

This section provides a general summary of the disclosure, and is not a comprehensive disclosure of its full scope or all of its features.

An example embodiment of a sight for a firearm according to the present disclosure includes a housing, a tritium light source, a light transmission rod, and a retainer. The housing is configured to be mounted to a firearm. The tritium light source is supported within the housing. The light transmission rod is disposed in a cavity of the housing and positioned adjacent the tritium light source. The light transmission rod is configured to collect and transmit both an ambient light and a light from the tritium light source. The retainer is removably engaged with the housing and fixes the light transmission rod within the cavity. Removal of the retainer provides access for replacement of the light transmission rod.

In at least one example embodiment, the tritium light source illuminates an axial surface of the light transmission rod.

In at least one example embodiment, the light transmission rod is a fiber optic rod.

In at least one example embodiment, the retainer is press-fit within the cavity in the housing.

In at least one example embodiment, the retainer includes threads that threadingly engage an inner surface of the cavity in the housing.

In at least one example embodiment, the sight may include a polymer patch on the threads of the retainer.

In at least one example embodiment, the light transmission rod is axially abutted by the retainer such that after the retainer is removed from the housing, the light transmission rod is slidably removable from the cavity.

In at least one example embodiment, the retainer defines an axially extending aperture, and the light transmission rod is aligned with the axially extending aperture to provide an aiming reference.

In at least one example embodiment, an exterior axial end surface of the retainer includes a colored coating or paint to provide a secondary aiming reference.

In at least one example embodiment, the housing includes a longitudinal opening into the cavity, the longitudinal opening exposing at least a top half of the light transmission rod.

In at least one example embodiment, an outside surface of the retainer includes a tool interface.

At least one example embodiment of a sight for a firearm according to the present disclosure includes a housing, an artificial light source, a light transmission rod, and a retainer. The housing is configured to be mounted to a firearm and includes a cavity therein. The artificial light source is disposed within the cavity of the housing. The light transmission rod is positioned in the cavity of the housing and is axially coupled to the illumination from the artificial light source. The light transmission rod is configured to collect and transmit both ambient light and light from the artificial light source. The retainer is removably engaged with the housing and fixes the light transmission rod within the cavity. Removal of the retainer provides access for replacement of the light transmission rod.

In at least one example embodiment, the artificial light source is a tritium lamp.

In at least one example embodiment, the artificial light source is a light emitting diode.

In at least one example embodiment, the light transmission rod is a fiber optic rod.

In at least one example embodiment, the retainer includes threads that threadingly engage an inner surface of the cavity in the housing or the retainer is press-fit within the cavity in the housing.

In at least one example embodiment, the light transmission rod is axially abutted by the retainer such that after the retainer is removed from the housing, the light transmission rod is slidably removable from the cavity.

In at least one example embodiment, an outside surface of the retainer includes a tool interface.

In at least one example embodiment, the tool interface is one of a hex, a square, a phillips, a cross, a star, a torx, a flathead, a slotted, or a spanner.

At least one example embodiment of a sight for a firearm according to the present disclosure includes a housing, an artificial light source, a light transmission rod, and a retainer. The housing is configured to be mounted to a firearm. The artificial light source is disposed within the housing. The light transmission rod is positioned in the housing. The light transmission rod is configured to collect and transmit both ambient light and light from the artificial light source. The retainer is threadably engaged with the housing and fixing the light transmission rod within the housing. The retainer defines an axially extending aperture that aligns with the light transmission rod to provide an aiming reference. Removal of the retainer provides access for replacement of the light transmission rod.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
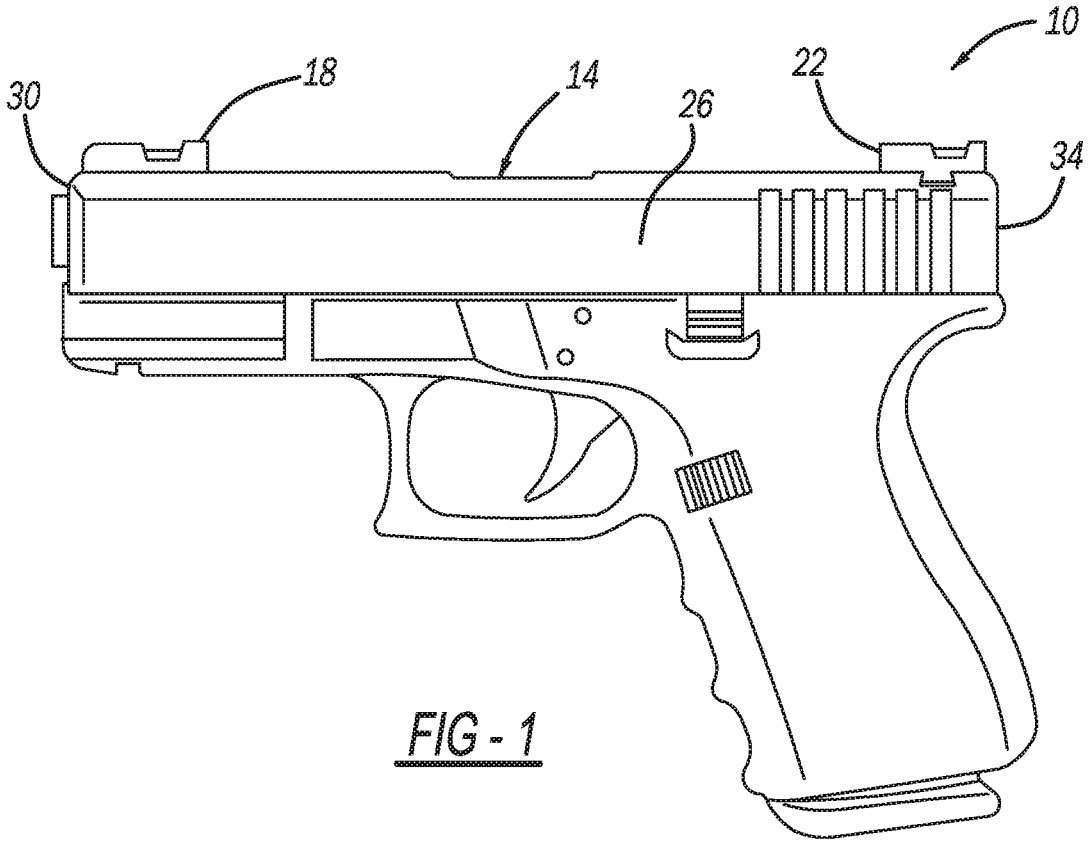
FIG. 1 is a perspective view of an example firearm including at least one example embodiment of a sighting device according to the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

A sighting device having a replaceable light transmitting rod is described herein. The sighting device provides the user with both daylight and low-light aiming references through the utilization of a replaceable light transmitting rod or segment held in place with a removable retainer and paired with an artificial light source. In at least one example embodiment, the sighting device may be an iron sight. In at least one example embodiment, the light transmitting rod may be a polished fiber segment. In at least one example embodiment, the light transmitting rod or segment may be a fiber optic. In at least one example embodiment, the light gathering rod may be cut to maximize light gathering capabilities and daylight brightness. In at least one example embodiment the artificial light source may be an LED or a tritium light source. In at least one example embodiment, the retainer may be a threaded retainer, a press-fit retainer, a snap-fit retainer, or a transverse pin retainer.

In at least one example embodiment, the light transmitting rod gathers ambient light during daylight brightness. The light transmitting rod directs the light longitudinally down the light transmitting rod to an end where the light is transmitted from the light transmitting rod, providing a daytime aiming reference. In at least one example embodiment, the light transmitting rod is paired with the artificial light source to gather artificial light during low-light conditions. The light transmitting rod directs the artificial light longitudinally down the light transmitting rod to the end where the artificial light is transmitted from the light transmitting rod, providing a low-light aiming reference.

In at least one example embodiment, an end of the artificial, or secondary, light source is axially aligned with an end of the light transmitting rod, such that the light from the artificial light source axially propagates into the end of the light transmitting rod. Axially aligning the artificial light source with the light transmitting rod provides increased brightness over other arrangements, including lateral alignment or alignment of the artificial light source along a longitudinal side of the light transmitting rod. For example, the end of the artificial, or secondary, light source may be axially coupled to and aligned with the end of the light transmitting rod. While the artificial light source is described a axially aligned with the light transmitting rod, it is understood that alternative example embodiments may incorporate side coupling, or otherwise configured, arrangements.

In at least one example embodiment, the retainer allows for replacement of the light transmitting rod at a user level. The retainer secures the light transmitting rod within a body of the sight. In at least one example embodiment, the retainer includes a tool interface which allows for removal of the retainer from the body and provides access to the light transmitting rod for removal and replacement. In at least one example embodiment, the tool interface may be a torx interface, a star interface, a hex interface, a square interface, a phillips interface, a cross interface, a slotted interface, a spanner interface, a flathead interface, etc.

In at least one example embodiment utilizing a threaded retainer, the retainer may include a polymer patch on the threads to prevent the retainer from backing out of the body. Alternative example embodiments may utilize other materials to secure the retainer, such as adhesive, threadlocker, etc. In at least one alternative example embodiment utilizing a threaded retainer, the threads may be right-hand threads. Right-hand threads eliminate the need for a polymer patch or other retaining mechanism because natural moments imparted by the action of firing the firearm make right-hand threads self-tightening.

In at least one example embodiment, the retainer may be a machined metal component. Alternatively, in at least one example embodiment, the retainer may be injection molded, for example, an injection molded polymer. Injection molding a polymer may allow for slight dimension modifications to make an interference fit with the sight body threads to lock the retainer in place and eliminate the need for thread patches, threadlockers, adhesives, etc. Injection molding a polymer may further allow for different color retainers without extra coatings or paint.

The sighting devices discussed in the present disclosure are advantageous over prior art sighting devices in that the removable retainer that engages the body of the sight provides easy and repeatable access to the light transmitting rod, allowing for replacement of the light transmission rod. It has been found that some sights utilizing light transmission rods, such as fiber optic rods, along with artificial light sources, such as tritium light sources, may have a limited life. For example, the fiber optic rod may be damaged and the prior art product may need to be replaced. However, the removable retainer of the sights discussed herein provides access to the light transmitting rod, allowing for replacement of the light transmission rod and giving the sight new life. Additionally, the ability to replace the light transmission rod allows for a user to change the color of the light transmission rod or customize the removable retainer (i.e., different colors or coatings). The customizable nature of the sight in the present disclosure is advantageous to users who use the same firearm (with the same sighting device) in varying environments, conditions, and situations where different colors or customization options are desirable.

Now referring to FIG. 1, at least one example embodiment of a sighting device 10 mounted on an example firearm 14 is illustrated. The firearm 14 may be any firearm 14 that receives a sighting device 10. The sighting device 10 may include a front sight, or forward sight, 18 and a rear sight 22. In at least one example embodiment, the rear sight 22 may be similar to the front sight 18 in that the rear sight 22 may include two front sight 18 assemblies fixed together in a single sight.

In at least one example embodiment, the front sight 18 and the rear sight 22 may be mounted to a slide 26 of the firearm 14. More specifically, the front sight 18 and the rear sight 22 may be mounted on a top side of the slide 26 and at opposing ends 30, 34 such that the sights 18, 22 may be viewed by an operator of the firearm and the front sight 18 may be aligned with the rear sight 22 to indicate an aiming point for the firearm 14.

Figure 2:
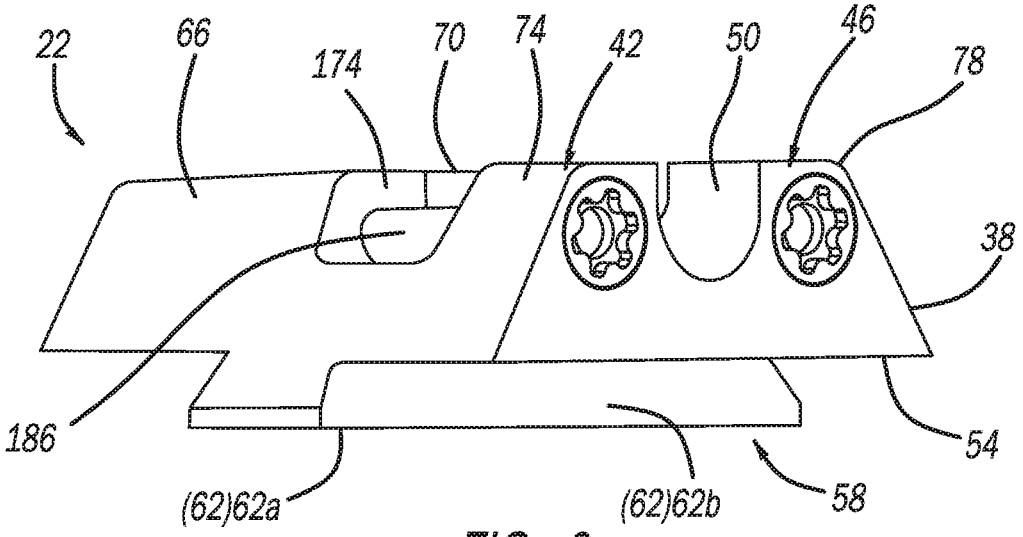
FIG. 2 is a perspective view of at least one example embodiment of a rear sight of the sighting device in FIG. 1.

Now referring to FIGS. 2-7, at least one example embodiment of the rear sight 22 is illustrated. In at least one example embodiment, the rear sight 22 includes a base, or housing, 38 defining a pair of aiming reference assemblies 42, 46 separated by a channel 50. A bottom surface 54 of the base 38 includes a firearm mount 58 for mounting the rear sight 22 on the firearm 14. In at least one example embodiment, the firearm mount 58 may project from the bottom surface 54 of the base 38 and may include at least one surface 62 (62*a*, 62*b*, 62*c*, etc.) that engages the firearm 14. The firearm mount 58 illustrated in FIG. 2 is a dovetail mount 58. However, the firearm mount 58 may be any shaped mount for securing the rear sight 22 on the firearm 14, such as a rounded projection, a circular projection, an oval-shaped projection, a rectangular projection, a polygonal projection, etc.

Figure 4:
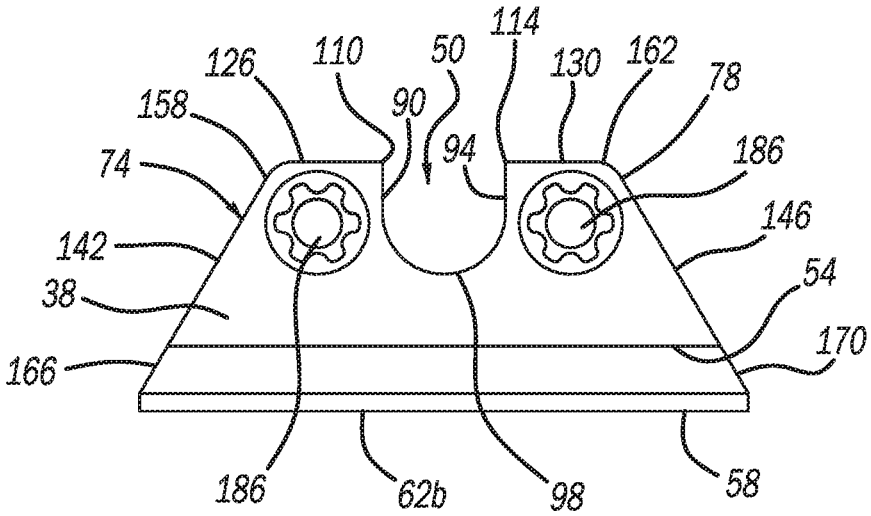
FIG. 4 is a user view of the rear sight in FIG. 2.
Figure 5:
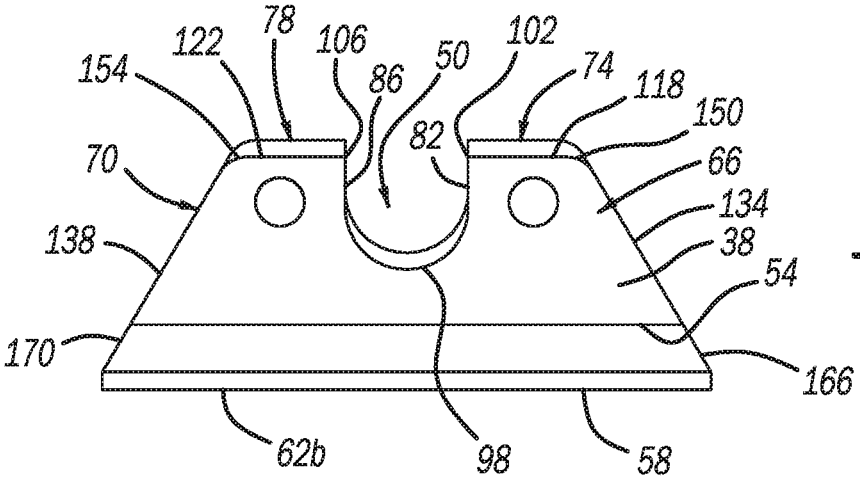
FIG. 5 is a forward face view of the rear sight in FIG. 2.

In at least one example embodiment, the base 38 may define front uprights 66, 70 and rear uprights 74, 78 that house the pair of aiming reference assemblies 42, 46, respectively. The channel 50 may be a U-shaped channel, and the uprights 66, 70, 74, 78 may each define one leg of the U-shaped channel. In at least one example embodiment, as best shown in FIGS. 4 and 5, each of the uprights 66, 70, 74, 78 includes an interior wall 82, 86, 90, 94. Front uprights 66, 70 may include interior walls 82, 86, respectively, that face each other (FIG. 5), and rear uprights 74, 78 may include interior walls 90, 94, respectively, that face each other (FIG. 4).

In at least one example embodiment, interior walls 82, 86, 90, 94 may extend vertically from a rounded base 98 of the U-shaped channel 50 to an interior corner 102, 106, 110, 114 of each upright 66, 70, 74, 78, respectively. Alternatively, the interior walls 82, 86, 90, 94 may extend at an angle, either toward a center of the U-shaped channel 50, or away from the center of the U-shaped channel 50. A top surface 118, 122, 126, 130 extending parallel with the bottom surface 54 of the base 38 may extend away from the interior wall 82, 86, 90, 94, on each respective upright 66, 70, 74, 78.

In at least one example embodiment, an exterior wall 134, 138, 142, 146 may extend at an angle away from the respective top surface 118, 122, 126, 130 and end at the bottom surface 54 of the base 38. The exterior wall 134, 138, 142, 146 may join the respective top surface 118, 122, 126, 130 at a rounded corner 150, 154, 158, 162 to provide aesthetic appeal, remove sharp edges, and reduce stress concentrations.

In at least one example embodiment, the exterior wall 134, 138, 142, 146 may be at an angle within a range of 105° to 165°, and more specifically at an angle of 120°, with respect to the top surface 118, 122, 126, 130. The exterior wall 134, 138, 142, 146 may also be at an angle within a range of 30° to 75°, and more specifically at an angle of 60°, with respect to the bottom surface 54 of the base 38.

In at least one example embodiment, the exterior wall 134, 138, 142, 146 may align with one of respective exterior walls 166, 170 of the firearm mount 58, such that in a view from the end of the rear sight 22, the exterior walls 134, 138, 142, 146, the exterior walls 166, 170, the bottom surface 62*b*, and the top surfaces 118, 122, 126, 130 form a trapezoid shape.

Figure 3:
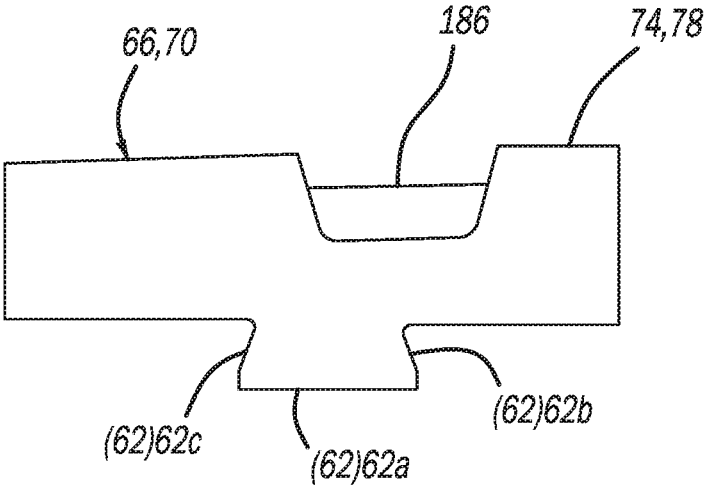
FIG. 3 is a side view of the rear sight in FIG. 2.
Figure 6:
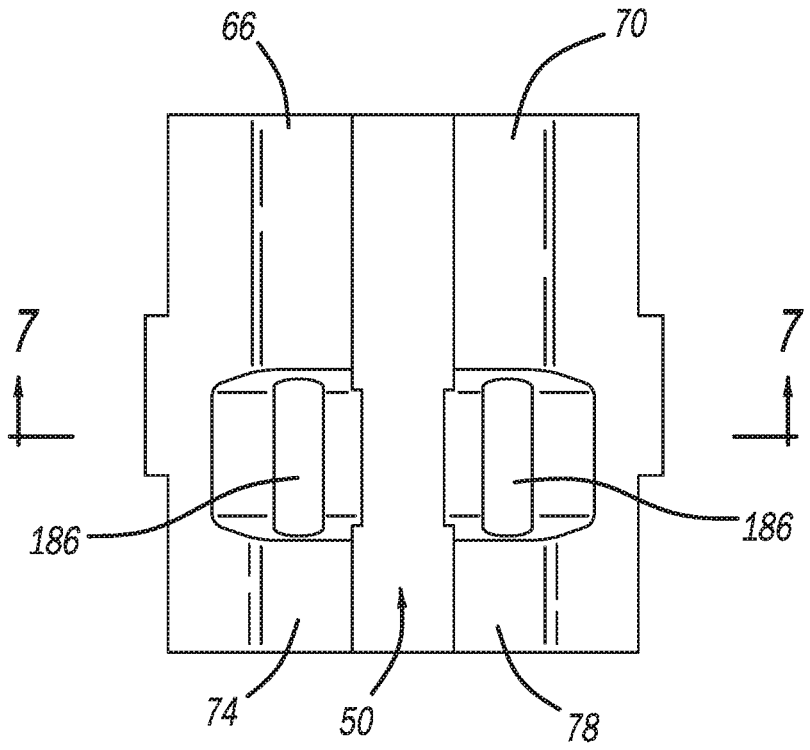
FIG. 6 is a top view of the rear sight in FIG. 2.
Figure 7:
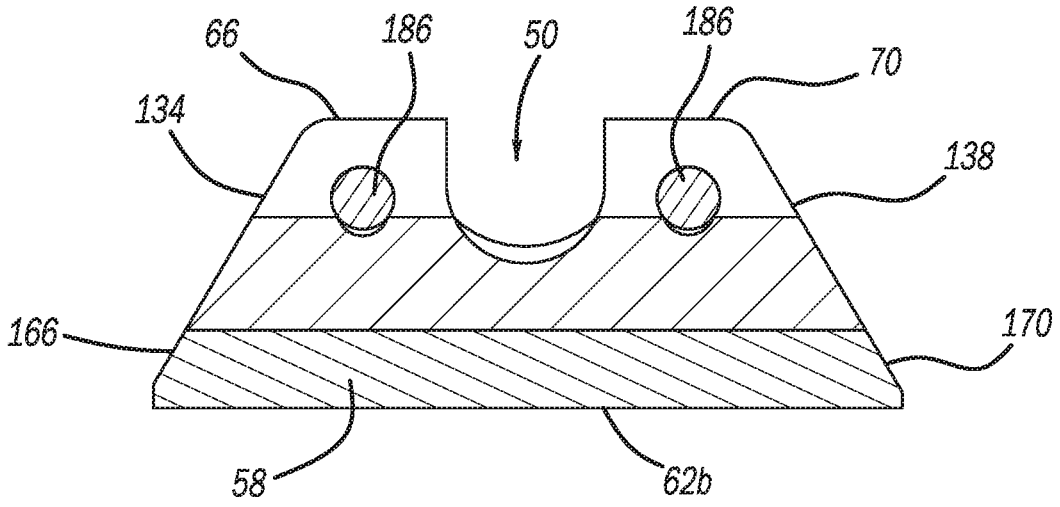
FIG. 7 is a cross sectional view of the rear sight cut at arrows 7-7 in FIG. 6.

In at least one embodiment, the front uprights 66, 70 may be separated from the rear uprights 74, 78 by a cutout 174 in the base 38, as best shown in FIGS. 2, 3, and 6. The cutout 174 may be a U-shaped cutout having slanted, or angled, legs. The slanted legs may be defined by a front surface 178 of each the rear uprights 74, 78 and a rear surface 182 of each of the front uprights 66, 70.

In at least one example embodiment, each of the rear uprights 74, 78 may define a cavity for receiving a first portion or a first end of a light transmission rod 186. Each of the front uprights 66, 70 may also define a cavity for receiving a second portion or a second end of the light transmission rod 186.

The light transmission rod 186 may be a rod configured to collect light (i.e., a light conductive rod) and transmit light (for example ambient light, artificial light, or a combination thereof). In at least one example embodiment, the light transmission rod 186 may be formed of light-gathering, fluorescent polymer material, fiber optic material, or another light conductive material. For example, the light transmission rod 186 may be a fiber optic rod, a polymer rod (such as plastic), or another light conductive rod. In at least one example embodiment, the light transmission rod 186 may be a cylindrical rod. However, the cylindrical rod is only one example, and it is understood that the light transmission rod 186 may include any cross-sectional shape.

For simplicity purposes, the assembly of the light transmission rod 186, front upright 66, rear upright 74, and internal components of each aiming reference assembly 42 are illustrated and described with reference to FIGS. 8-19, described below. The example embodiments in each of FIGS. 8-19, described below, may be incorporated into each of the aiming reference assemblies 42, 46 and the pairs of front uprights 66, 70 and rear uprights 74, 78, respectively.

Figure 8:
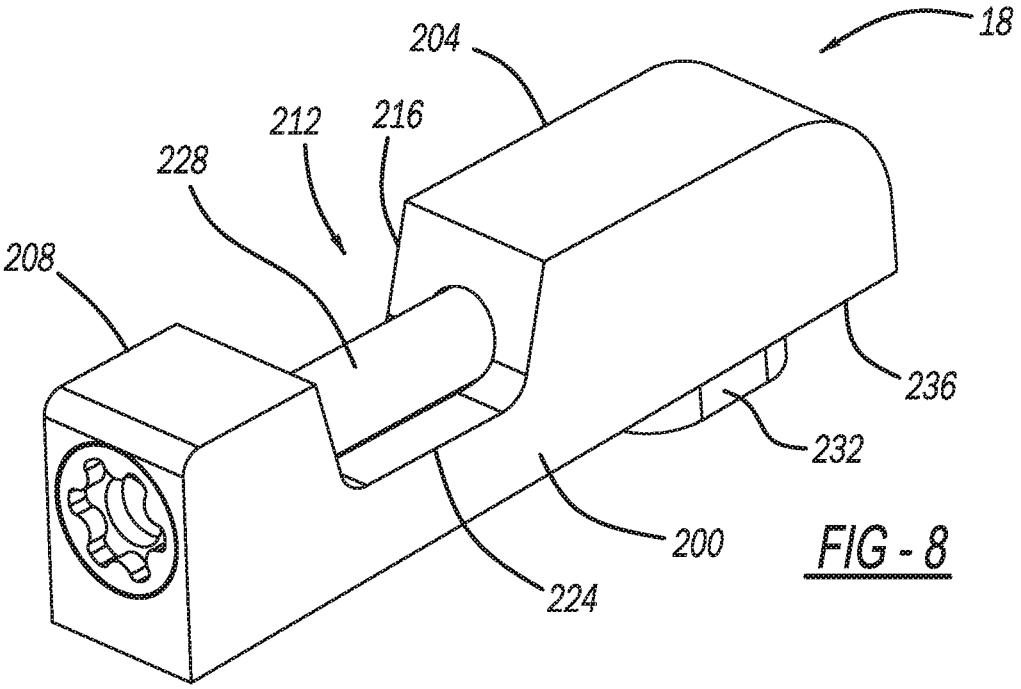
FIG. 8 is a perspective view of at least one example embodiment of a front sight of the sighting device in FIG. 1.
Figure 9:
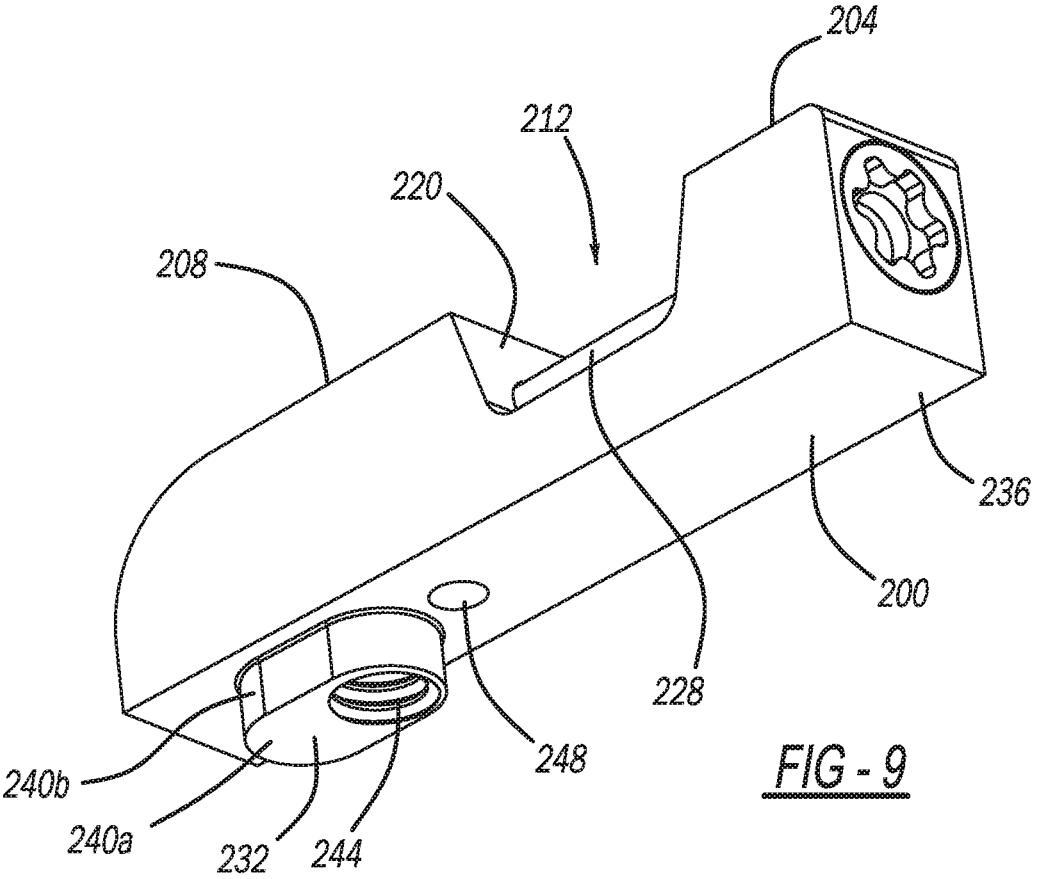
FIG. 9 is another perspective view of the front sight in FIG. 8.

Now referring to FIGS. 8-11, an example embodiment of the front sight 18 is illustrated. As shown in FIGS. 8 and 9, similar to the rear sight (but only half the rear sight, as previously described), the front sight 18 includes a base, or housing, 200 having a front upright 204 and a rear upright 208 separated by a cutout 212 defined by the front upright 204 and the rear upright 208. The cutout 212 may be a U-shaped cutout having angled legs defined by a rear surface 216 of the font upright 204 and a front surface 220 of the rear upright 208. For example, the rear surface 216 of the front upright 204 may extend at an angle within a range of 95° to 130° relative to a base 224 of the cutout 212, and the front surface 220 of the rear upright 208 may extend at an angle within a range of 92° to 130° relative to the base 224 of the cutout 212. The angled rear surface 216 and front surface 220 may provide maximum exposure of a light transmission rod 228 supported by the front upright 204 and rear upright 208.

As previously described, the projection 232 may include at least one surface 240 (i.e., 240*a*, 240*b*, etc.) that engages the firearm 14. The projection 232 illustrated in FIG. 9 is an oval-shaped projection. However, the projection 232 may be any shaped mount for securing the front sight 18 on the firearm 14, such as a rounded projection, a circular projection, a rectangular projection, a polygonal projection, a dovetail projection, etc. In at least one example embodiment, the projection 232 may include a threaded aperture 244 configured to engage a threaded rod (not illustrated) and secure the front sight 18 on the firearm 14.

In at least one example embodiment, the base 200 may define an aperture 248 adjacent the projection 232. The aperture 248 may provide access for adhesive dispensing and/or application during assembly. In some embodiments, adhesive may be used to bond the secondary, or artificial, light source to the cavity of the front upright.

Figure 10:
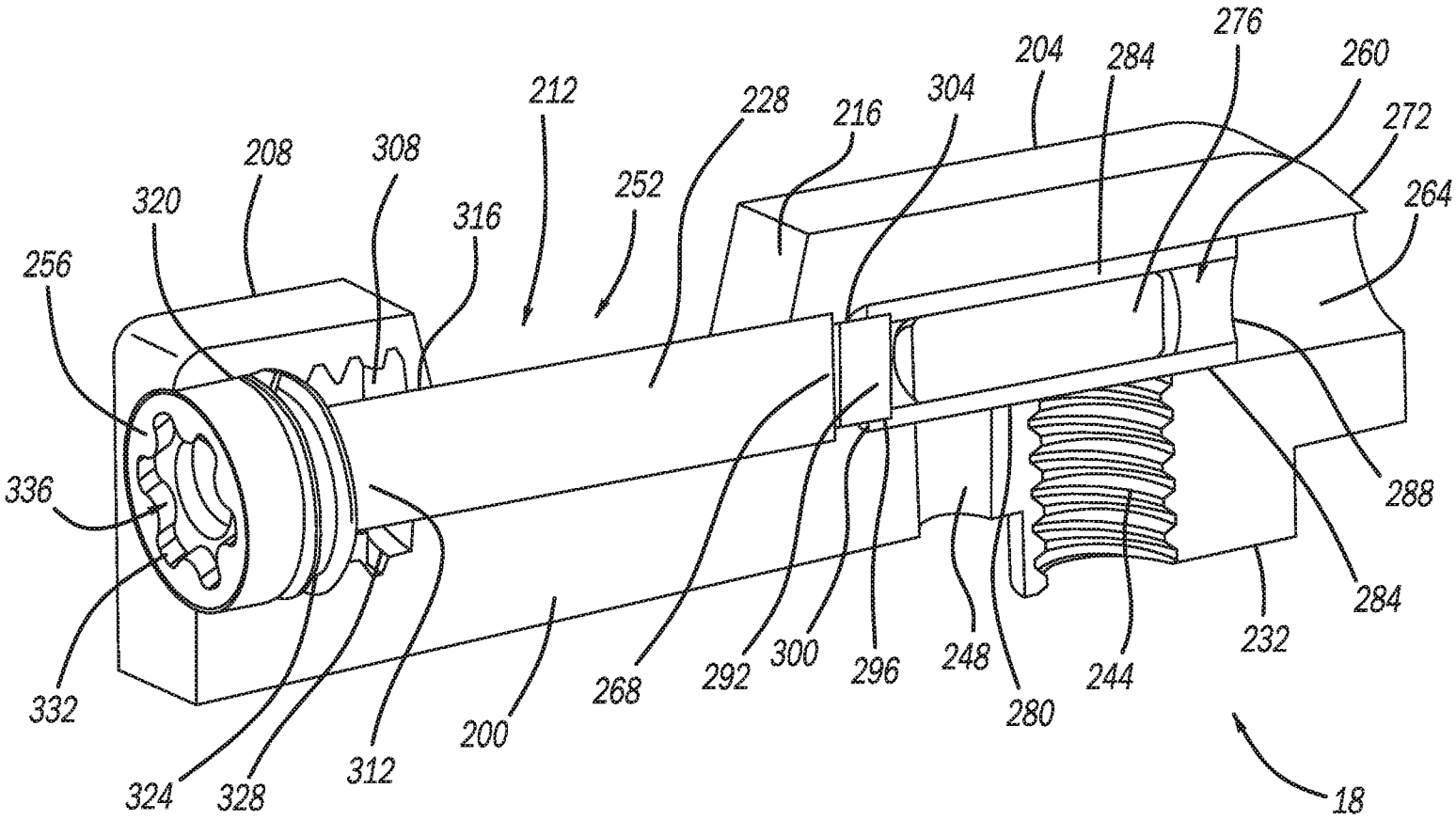
FIG. 10 is a cross sectional view of the front sight in FIG. 8, cut along a longitudinal axis of the front sight.
Figure 11:
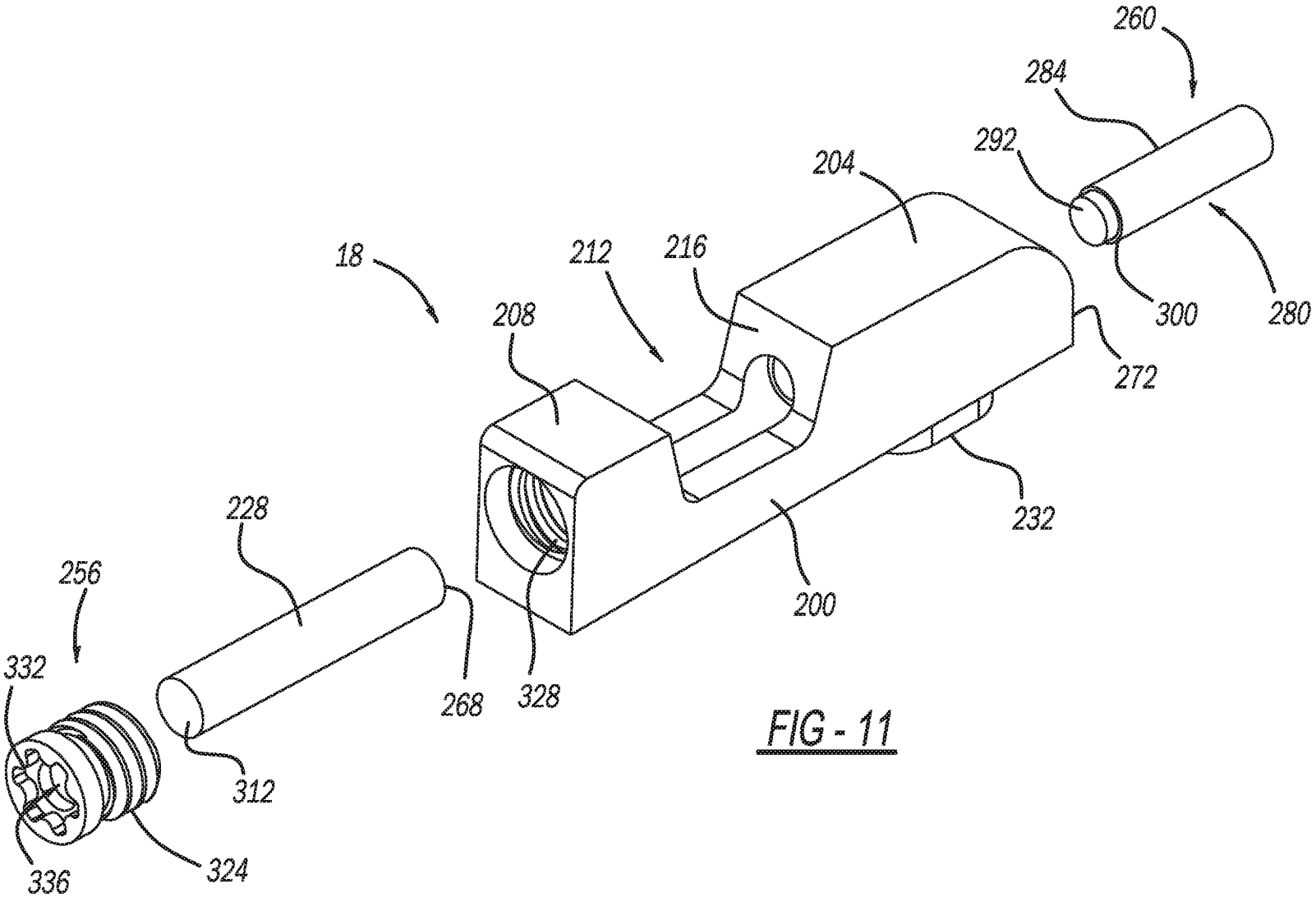
FIG. 11 is an exploded view of the front sight in FIG. 8.
Figure 12:
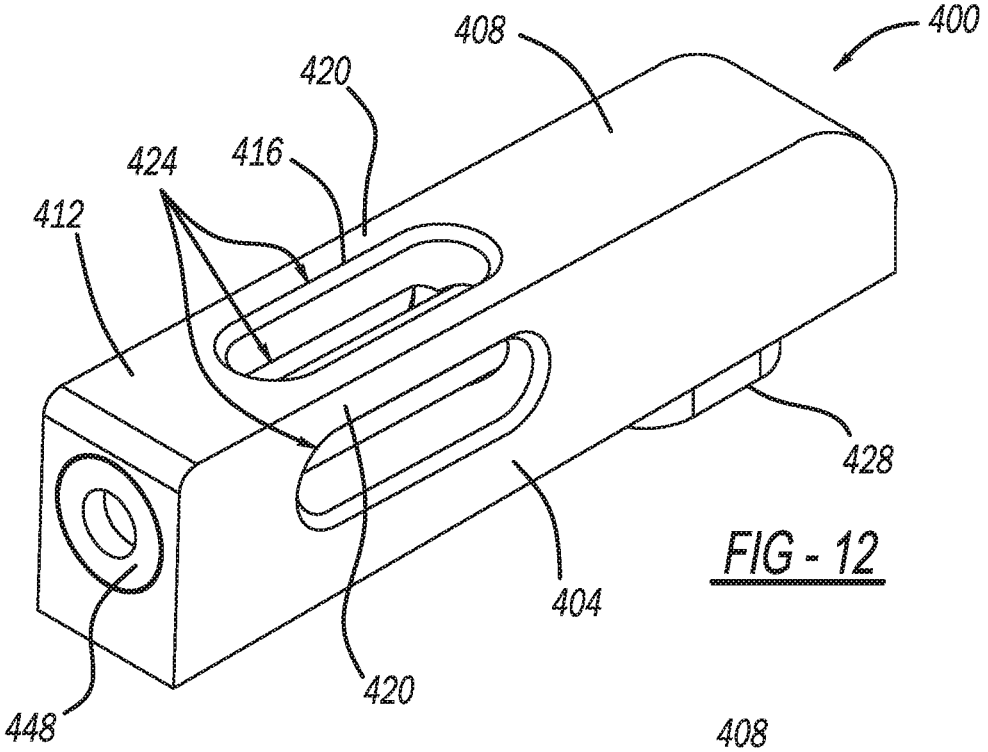
FIG. 12 is a perspective view of at least one example embodiment of a front sight of the sighting device in FIG. 1.
Figure 13:
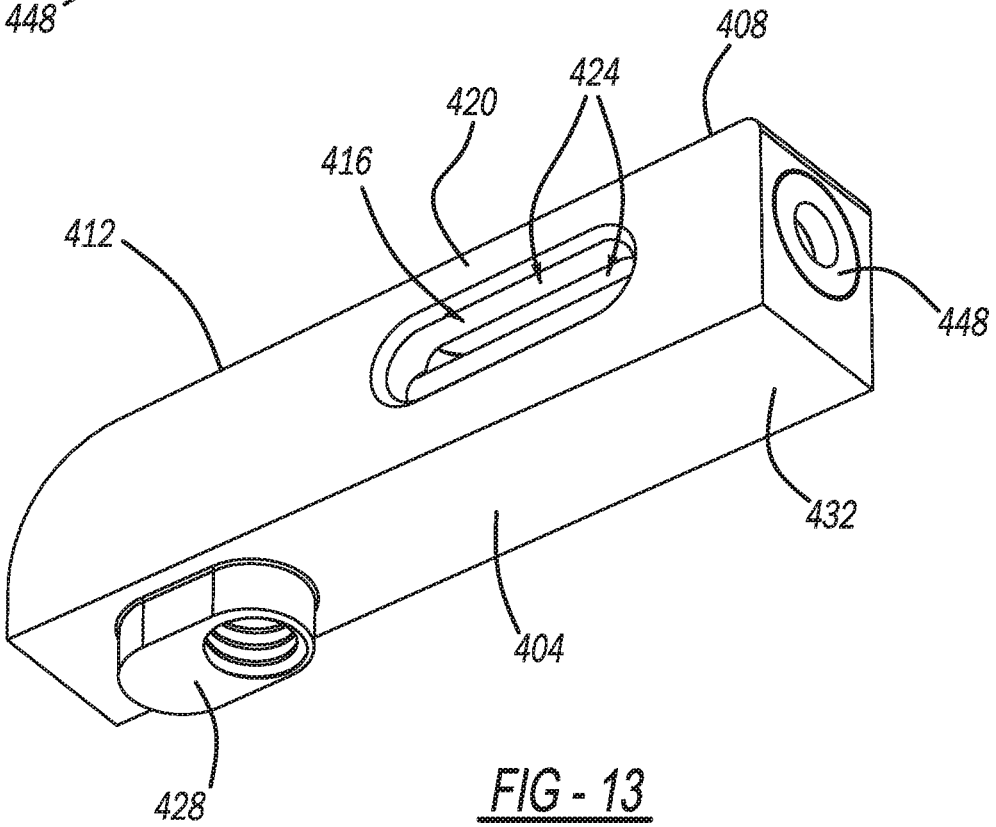
FIG. 13 is another perspective view of the front sight in FIG. 12.

Now referring to FIGS. 10 and 11, the base 200 may house an aiming reference assembly 252. The aiming reference assembly 252 may include a retainer 256, the light transmission rod 228, and an artificial light source 260. In at least one example embodiment, the front upright 204 may define a cavity 264 for supporting the artificial light source 260 and a front end 268 of the light transmission rod 228. The cavity 264 may be an elongated bore extending from a front surface 272 to a rear surface 216 of the front upright 204. In at least one example embodiment, the cavity 264 may be a cylindrical bore. In at least one alternative example embodiment, the cavity 264 may include any cross-sectional shape that matches a cross sectional shape of at least one of the artificial light source 260 and the front end 268 of the light transmission rod 228.

In at least one example embodiment the threaded aperture 244 of the firearm mount 232 and/or the aperture 248 in the base 200 may intersect the cavity 264 in the front upright 204. Accordingly, the threaded rod (not illustrated) received by the threaded aperture 244 in the firearm mount 232 may serve a dual purpose of retaining the artificial light source 260 in the cavity 264. For example, the threaded rod retaining the artificial light source 260 in the cavity 264 may be especially applicable where the artificial light source 260 is a non-radioluminescent light source. Additionally, or alternatively, a pin received by the aperture 248 in the base 200 may serve a dual purpose of retaining the artificial light source 260 in the cavity 264. For example, a pin serving the dual purpose of retaining the artificial light source 260 in the cavity 264 may be especially applicable where the artificial light source 260 is a non-radioluminescent light source.

In at least one example embodiment, artificial, or secondary, light source 260 may be configured to provide artificial, or produced, light to the light transmission rod 228. For example, the artificial light source 260 may be formed of a material that includes phosphorescent or long-afterglow pigments. In at least one example embodiment, the artificial light source 260 may be a radioluminescent, or radioactive light-emitting, light source, such as a tritium light source or a tritium vial. The tritium vial may be constructed of a borosilicate tube coated on its inner surface with a phosphor compound. The tube houses tritium gas which interacts with the phosphor compound to produce light in the visible spectrum (for example, red, orange, yellow, green, blue, indigo, violet colors of light may be produced by different preparations of the phosphor compound). In at least one alternative example embodiment, a different type of artificial, or secondary, light source may be utilized, such as a light-emitting diode (LED) (for example, a battery powered, or otherwise powered, LED) or other powered light source.

In at least one example embodiment, when the artificial light source 260 includes a tritium light source, a tritium vial 276 may be disposed within a casing, or capsule, 280. The tritium vial 276 may be a shell encapsulating the tritium or other radioactive material. The casing 280 may include a continuous side wall (for example, tubular side walls, such as cylindrical side walls or any cross-sectional shaped side walls matching a cross-sectional shape of the tritium vial 276) 284, an end cap, or first capsule end, 288 (or base, plug, etc.), and a cover, or second capsule end, 292 (or cap, plug, etc.). The end cap 288 may be integrally formed with the side wall 284. Alternatively, the end cap 288 may be fixed to the side wall 284 by any fixing means including adhesive, press-fitting, heat sealing, fastening, clamping, etc. The casing 280 may protectively shield the tritium vial 276 in the cavity 264. In at least one example embodiment, the cover 292 may be formed of a transparent shock absorbing or deformable material, such as silicone, etc. In at least one example embodiment, the cover 292 may be a lens.

A diameter of the cover 292 may be greater than an inner diameter of the side walls 284 but less than an outer diameter of the side walls, such that the cover 292 fits within a recess, or stepped portion, 296 on a free end 300 of the side walls 284. In at least one example embodiment, the cover 292 may be sealed to the side wall 284 to seal the internal components (i.e., tritium vial) within the casing 280. Additionally, the diameter of the cover 292 may fit within a reduced diameter portion, or ridge, 304 in the cavity 264. The ridge 304 may prevent the sidewall 284 of the casing 280 (and the tritium vial 276) from moving rearward in the front upright 204.

In at least one example embodiment, the side walls 284, end cap 288, and cover 292 of the casing 280 may be formed of a translucent or transparent material such that radiant energy may pass therethrough and be incident on the light transmission rod 228. For example, the side walls 284, end cap 288, and cover 292 may be formed from glass (such as borosilicate glass), a polymer (such as plastic), a fluorinated polymer (such as Teflon®), other suitable materials, or a combination thereof.

In at least one example embodiment, the light transmission rod 228 may be positioned adjacent the artificial light source 260, and, more specifically, abutting the cover 292 on the free end 300 of the casing 280. While FIG. 10 illustrates the light transmission rod 228 abutting the cover 292 of the casing 280, it is understood that the light transmission rod 228 may abut a light emitting end of an LED or other artificial light source instead of the tritium artificial light source.

In at least one example embodiment, the light from the artificial light source 260 axially propagates into the light transmission rod 228. In at least one example embodiment, the light transmission rod 228 may be the same as, or similar to light transmission rod 186. Light transmission rod 228 may be a rod configured to collect light (i.e., a light conductive rod) and transmit light (for example ambient light, artificial light, or a combination thereof). In at least one example embodiment, the light transmission rod 186 may be formed of light-gathering, fluorescent polymer material, fiber optic material, another light conductive material, or a combination thereof. For example, the light transmission rod 186 may be a fiber optic rod, a polymer rod (such as plastic), a fluorescent-doped fiber optic, or another light conductive rod. In a suitable fiber optic rod, when radiation is received along a length of the fiber optic rod, energy is absorbed in the fiber optic at a first wavelength. The energy is then emitted at both ends of the fiber optic at a longer wavelength than the first wavelength. Thus, a proportionate amount of radiation is emitted at the ends of the fiber optic as the radiation absorbed. For example, a suitable fiber optic rod may consist of a core material doped to transmit the desired wavelength of light and a fluoropolymer cladding to shield the core from chemical attack. However, it is understood that the light transmission rod 228 is not limited to the material discussed herein and could be any material that collects and transmits light.

In at least one example embodiment, the light transmission rod 186 may be a cylindrical rod. However, the cylindrical rod is only one example, and it is understood that the light transmission rod 186 may include any cross-sectional shape. Other cross-sectional shapes may include oval, polygonal, rectangular, triangular, arcuate, etc. Further, it is understood that a length, diameter, thickness, etc., of the light transmission rod 228 may vary based on the dimensions of the sighting device 10.

With the cover 292 on the artificial light source 260 being held in the ridge 304 of the cavity 264, the light transmission rod 186 may be abutted against the ridge 304 to axially position the light transmission rod 186 relative to the cover 292 and against the cover 292 to receive light therefrom.

The rear upright 208 may define a cavity 308 for supporting the retainer 256 and a rear end 312 of the light transmission rod 228. In at least one example embodiment, the cavity 308 may be a tubular aperture extending a longitudinal length of the rear upright 208. The cavity 308 may include a neck 316 and a body 320, with the neck 316 having a reduced diameter for receiving the light transmission rod 228 and the body 320 having a larger diameter for receiving the retainer 256.

The retainer 256 may be configured to removably secure the light transmission rod 228 within the cavity 308. In at least one example embodiment, the retainer 256 may include threads 324 that mate with internal threads 328 on the body 320 of the cavity 308 to secure the retainer 256 within the cavity 308. In at least one example embodiment, the retainer 256 may include a tool interface 332 configured to receive a tool for engaging and disengaging the threads 324 with the inner threads 328 and selectively providing access to the light transmission rod 228. For example, the tool interface 332 may be a torx tool interface, such as a T10 torx interface, as illustrated, a star interface, a hex interface, a square interface, a phillips interface, a cross interface, a slotted interface, a spanner interface, a flathead interface, or any other drive feature.

In at least one example embodiment, the retainer 256 may include an aperture 336 along a longitudinal axis and aligning with a longitudinal axis of the body 320 and the neck 316, such that in an end view, the aperture 336 is concentric with the body 320 and the neck 316. A diameter of the aperture 336 may be less than a diameter of the neck 316 and less than a diameter of the light transmission rod 228. The aperture 336 may provide an exit for the light transmitted by the light transmission rod 228 and an aiming reference for the front sight 18.

In at least one example embodiment, the retainer 256 may be a machined metal component. Alternatively, the retainer 256 may be an injection molded polymer. For example, the retainer 256 may be manufactured at an interference fit to lock the retainer 256 within the body 320. In at least one example embodiment, a polymer patch, adhesive, threadlocker, etc., may be used to secure the threads 324 on the retainer 256 with the inner threads 328 in the body 320. Alternatively, the threads 324 on the retainer 256 and inner threads 328 in the body 320 may be right-hand threads such that the retainer 256 is self-tightening from the force imparted when the firearm 14 is fired.

In at least one example embodiment, the retainer 256 may be a secondary aiming reference. For example, the retainer 256 may include a colored coating, paint, dye, colored material, etc. to distinguish the retainer 256 from the base 200 and the light transmission rod 228. Alternatively, the retainer may include a colored coating, paint, dye, colored material, etc. that distinguishes the retainer 256 from the base 200 but matches the light transmission rod 228. The coating, paint, dye, material, etc., may be fluorescent, glossy, matte, any color, or include any surface effect that provides a secondary aiming reference for a user.

In at least one example embodiment, the light transmission rod 186 is exposed to natural light, or sunlight, in the cutout 212 as the light transmission rod 186 extends between the cavity 264 in the front upright 204 and the cavity 308 in the rear upright 208.

In use, the artificial light source 260 is secured within the cavity 264 of the front upright 204 by the threaded rod (not illustrated) in the threaded aperture 244 and/or the pin (not illustrated) in the aperture 248. The artificial light source 260 is held in position within the ridge 304 in the cavity 264, and more specifically, a cover 292 for the artificial light source 260 is held in the ridge 304.

The front end 268 of the light transmission rod 228 may be inserted through the cavity 308 (through both the body 320 and neck 316), through the cutout 212, and into the cavity 264, abutting the ridge 304 and the artificial light source 260. In at least one example embodiment, the front end 268 of the light transmission rod 228 abuts the cover 292 for the tritium vial 276.

When the front end 268 of the light transmission rod 228 abuts the ridge 304, the light transmission rod 228 extends through the cutout 212, and into the neck 316 and body 320 of the cavity 308 in the rear upright 208. The retainer 256 is engaged within the body 320 of the cavity 308 in the rear upright 208. More specifically the threads 324 engage the inner threads 328 in the body 320 to secure the retainer 256 within the cavity 308. In at least one example embodiment, a tool engages the tool interface 332 on the retainer 256 to thread the retainer 256 into the cavity 308. In at least one example embodiment, a polymer patch, adhesive, threadlocker, etc., may be used to secure the threads 324 on the retainer 256 with the inner threads 328 in the body 320. Alternatively, the threads 324 on the retainer 256 and inner threads 328 in the body 320 may be right-hand threads such that the retainer 256 is self-tightening from the force imparted when the firearm 14 is fired. Alternatively, the threaded retainer 256 may be an injection molded polymer. For example, the injection molded retainer 256 may be manufactured at an interference fit to lock the retainer 256 within the body 320.

During daylight conditions, the light transmission rod 228 is exposed to light along its length in the cutout 212 of the base 200. Light incident on the light transmission rod 228 is absorbed (for example, by the fiber optic), transmitted along a length of the light transmission rod 228, and is emitted at the rear end 312 of the light transmission rod 228. The rear end 312 is viewable by a user through the aperture 336 in the tool interface 332 of the retainer 256 to thereby provide an illuminated sight point or aiming reference for alignment with a desired target.

During low light conditions, the light transmission rod 228 is exposed to artificial light at the front end 268, or axial surface, adjacent the artificial light source 260. Light incident on the front end 268, or axial surface, of the light transmission rod 228 is absorbed (for example, by the fiber optic), transmitted along a length of the light transmission rod 228, and is emitted at the rear end 312 of the light transmission rod 228. The rear end 312 is viewable by a user through the aperture 336 in the tool interface 332 of the retainer 256 to thereby provide an illuminated sight point or aiming reference for alignment with a desired target.

During low light conditions, the light transmission rod 228 may additionally be exposed to light along its length in the cutout 212 of the base 200. The light incident on the light transmission rod 228 is absorbed (for example, by the fiber optic), combined with the artificial light from the artificial light source 260, transmitted along a length of the light transmission rod 228 with the artificial light, and is emitted in combination at the rear end 312 of the light transmission rod 228.

When a user desires to change out the light transmission rod 228 for any reason (for example, to change the color of the light transmission rod or to install a new light transmission rod 228), a tool having a mating tool head with the tool interface 332 may be engaged with the tool interface 332. In at least one example embodiment, the tool head (not illustrated) may be rotated counterclockwise to disengage the threads 324 on the retainer 256 with the inner threads 328 on the rear upright 208. Disengagement of the threads 324 on the retainer 256 with the inner threads 328 moves the retainer 256 from axial engagement with the rear end 312 of the light transmission rod 228. In at least one alternative example embodiment, the tool head (not illustrated) may be rotated clockwise to disengage the threads 324 on the retainer 256 with the inner threads 328 on the rear upright 208.

With the retainer 256 completely removed from the cavity 308 in the rear upright 208, the light transmission rod 228 may be removed from the cavity 264 in the front upright 204, the cutout 212, and the cavity 308 in the rear upright 208. A new or different light transmission rod 228 may be inserted through the cavity 308 and the cutout 212, and into the cavity 264 adjacent the artificial light source 260 and/or ridge 304. For example, the light transmission rod 228 may move into engagement with the artificial light source 260, may be positioned to abut the artificial light source 260, may be positioned to abut the ridge 304, or a combination of these.

The retainer 256 may be replaced within the cavity 308 by aligning the retainer 256 with the longitudinal axis of the body 320 and the neck 316 of the cavity 308 and rotating the retainer 256 to engage the threads 324 on the retainer 256 with the inner threads 328 of the cavity 308. In at least one example embodiment, the retainer 256 may be rotated clockwise to engage the threads 324 on the retainer 256 with the inner threads 328 on the rear upright 208. In at least one alternative example embodiment, the retainer may be rotated counterclockwise to engage the threads 324 on the retainer 256 with the inner threads 328 on the rear upright 208. In at least one example embodiment, a tool having a mating tool head with the tool interface 332 may be engaged with the tool interface 332 on the retainer 256 and rotated to secure the retainer 256 within the cavity 308. The retainer 256 may be rotated until the retainer 256 axially abuts or engages the rear end 312 of the light transmission rod 228.

Now referring to FIGS. 12-15, at least one example embodiment of a sight 400 is illustrated. The sight 400 may be similar to the sight 18. In at least one example embodiment, the sight 400 may include a base, or housing, 404. A front upright 408 and rear upright 412 may be separated by, and define, a cutout 416. While the front upright 408 and rear upright 412 may be similar to front upright 204 and rear upright 208, front upright 408 and rear upright 412 may be connected by beams 420 enclosing the corners of cutout 416 and defining windows, or longitudinal openings, 424 providing access to the cutout 416. In at least one example embodiment, beams 420 may be integrally formed with the front upright 408 and the rear upright 412. While the sight 400 may be illustrated and described as having beams 420, it is understood that the sight 400 may be similar to the sight 18 and may not include beams 420, but instead may have an open cutout similar to the cutout 212.

In at least one example embodiment, a projection 428 may extend from a bottom surface 432 of the base 404, opposite the front upright 408 and rear upright 412. The projection 428 may serve as a mount for firearm 14. The projection 428 may be the same as projection 232. In at least one alternative example embodiment, the projection 428 may be any shaped mount for securing the sight 400 on the firearm 14, such as a rounded projection, a circular projection, a rectangular projection, a polygonal projection, a dovetail projection, etc.

Figure 14:
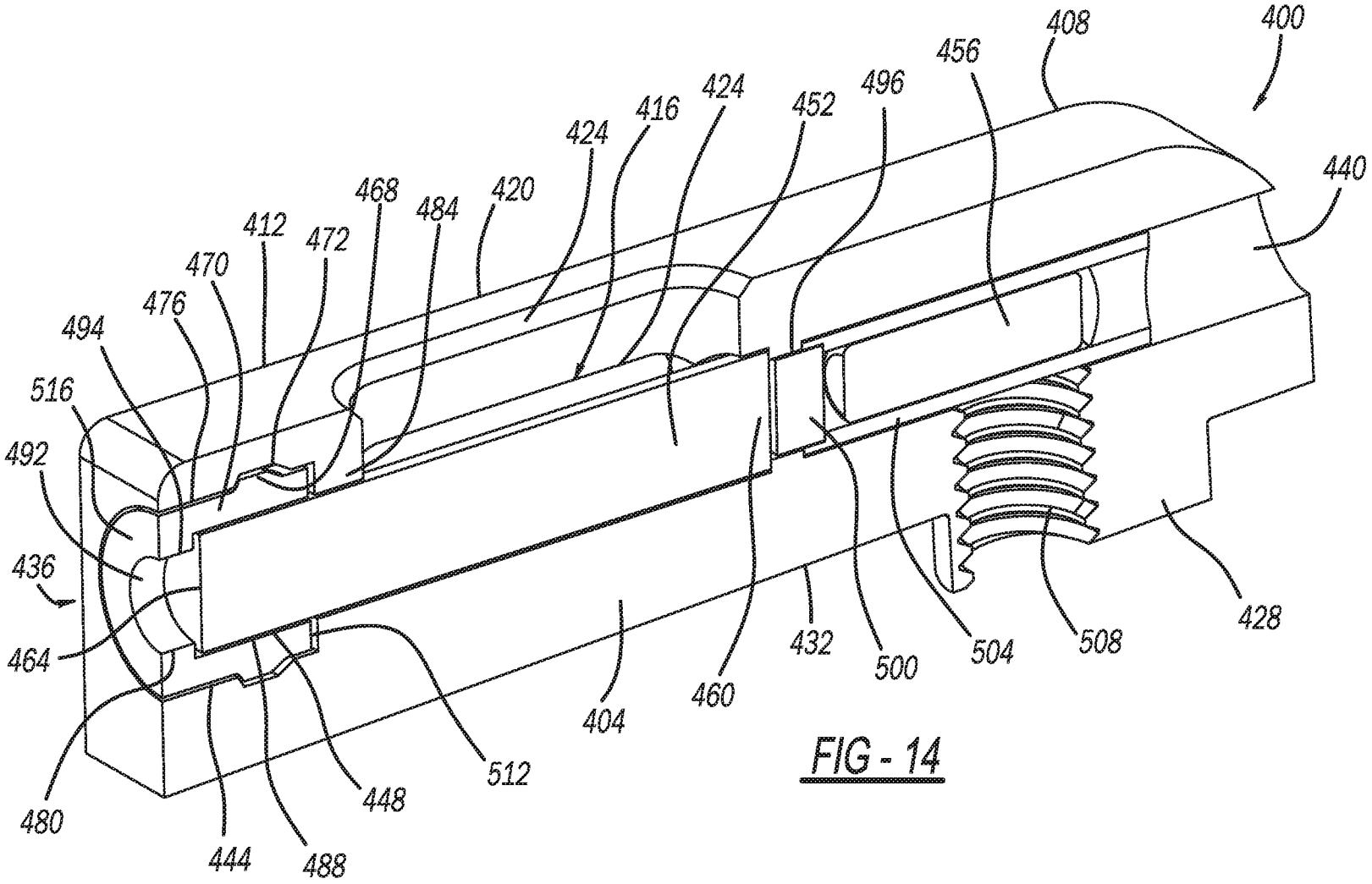
FIG. 14 is a cross sectional view of the front sight in FIG. 12, cut along a longitudinal axis of the front sight.
Figure 15:
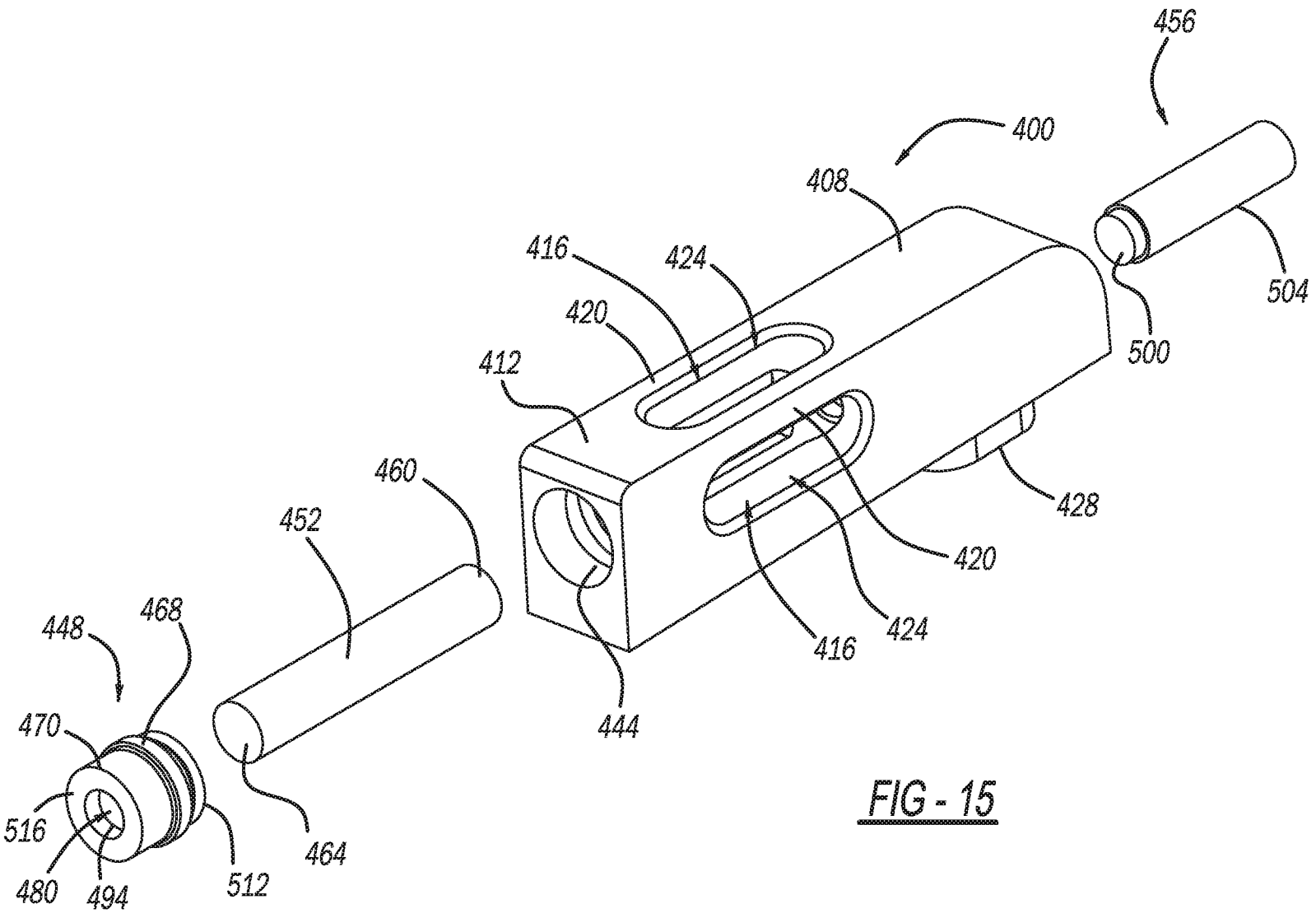
FIG. 15 is an exploded view of the front sight in FIG. 12.
Figure 16:
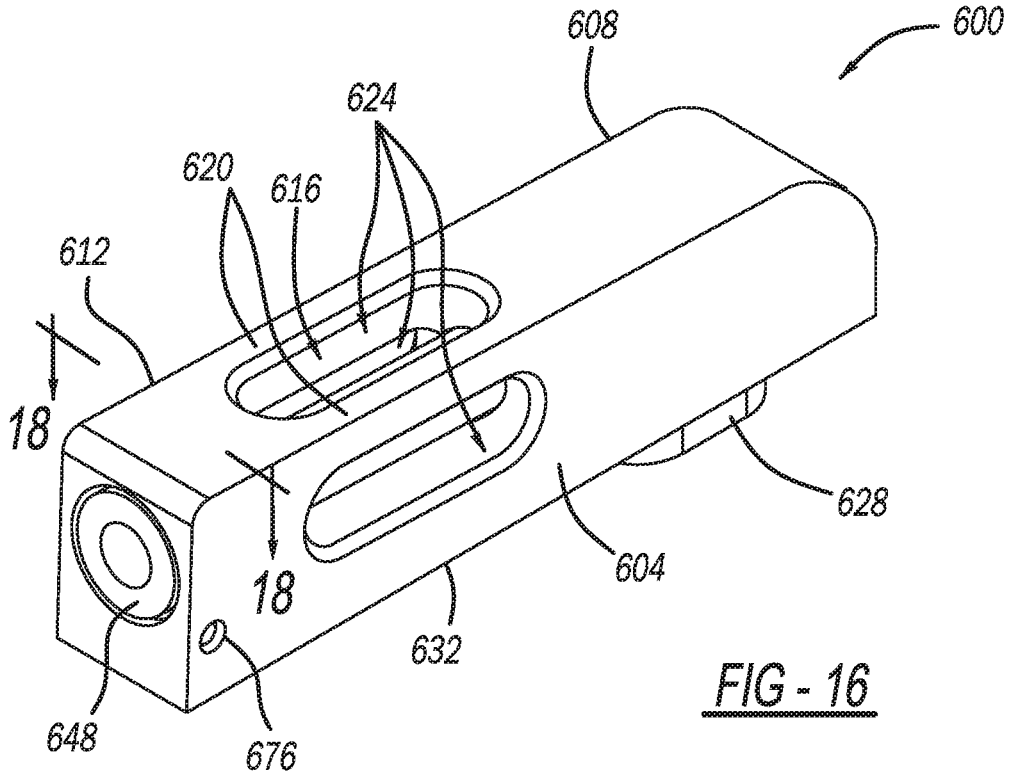
FIG. 16 is a perspective view of at least one example embodiment of a front sight of the sighting device in FIG. 1.

Referring to FIGS. 14 and 15, in at least one example embodiment, an aiming reference assembly 436 may be supported within a cavity 440 in the front upright 408 and a cavity 444 in the rear upright 412. The aiming reference assembly 436 may be similar to the aiming reference assembly 252 and may include a retainer 448, a light transmission rod 452, and an artificial light source 456. In at least one example embodiment, the cavity 440 may support the artificial light source 456 and a front end 460 of the light transmission rod 452, and the cavity 444 may support the retainer 448 and a rear end 464 of the light transmission rod 452.

In at least one example embodiment, the light transmission rod 452 may be similar to light transmission rod 228. Additionally, in at least one example embodiment, the artificial light source 456 may be the same or similar to the artificial light source 260.

In at least one example embodiment, the retainer 448 may be configured to secure the light transmission rod 452 within the cavity 444. In at least one example embodiment, the retainer 448 may be a snap fit retainer and may include a ridge 468 in a sidewall 470 of the retainer 448 that mates or engages with a channel, or groove, 472 on a body 476 of the cavity 444 to secure the retainer 448 within the cavity 444. In at least one example embodiment, the retainer 448 may be a tubular retainer, having a cylindrical shape. Alternatively, it is understood that the retainer 448 is not limited to a cylindrical shape, and could have any cross sectional shape, such as an ellipsoidal shape, a rectangular shape, a square shape, a triangular shape, a hexagonal shape, etc.

In at least one example embodiment, the retainer 448 may include an aperture 480 extending a length of the retainer 448 along a longitudinal axis and aligning with a longitudinal axis of the cavity 444, such that in an end view, the aperture 480 is concentric with the body 476 and a neck 484 of the cavity 444. The aperture 480 may include a support section 488 and an aiming point section 492, where the support section 488 includes a diameter larger than a diameter of a bore 494 in the aiming point section 492. The diameter of the support section 488 of the aperture 480 may be equal to or within a range of 0 to 5% larger or smaller than a diameter of the neck 484 and equal to or slightly larger (for example, 0-2% larger) than a diameter of the light transmission rod 452, such that the light transmission rod 452 may fit within the support section 488. The diameter of the bore 494 in the aiming point section 492 of the aperture 480 may be less than the diameters of the support section 488, the neck 484, and the light transmission rod 452 such that aiming point section 492 of the retainer 448 acts as a stop, preventing movement of the light transmission rod 452 outside of the cavity 444. Additionally, the bore 494 provides an exit for the light transmitted by the light transmission rod 452 and an aiming point for the sight 400.

In at least one example embodiment, the retainer 448 may be an injection molded polymer, and may be, for example, manufactured at an interference fit to lock the retainer 448 within the body 476. Alternatively, the retainer 448 may be formed of any other appropriate material.

In at least one example embodiment, the retainer 448 may be a secondary aiming reference. For example, the retainer 448 may include a colored coating, paint, dye, colored material, etc. to distinguish the retainer 448 from the base 404 and the light transmission rod 452. Alternatively, the retainer 448 may include a colored coating, paint, dye, colored material, etc. that distinguishes the retainer 448 from the base 404 but matches the light transmission rod 452. The coating, paint, dye, material, etc., may be fluorescent, glossy, matte, any color, or include any effect that provides a secondary aiming reference for a user.

In at least one example embodiment, the light transmission rod 452 is exposed to natural light, or sunlight, through the windows 424 in the cutout 416 as the light transmission rod 452 extends between the cavity 440 in the front upright 408 and the cavity 444 in the rear upright 412.

In use, the artificial light source 456 may be secured within the cavity 440 of the front upright 408 through the engagement between a ridge (or decreased diameter portion) 496 in the cavity 440 and the artificial light source 456. More specifically, in at least one example embodiment, a cover 500 of a casing, or canister, 504 enclosing the artificial light source 456 may be supported within the ridge 496. The cover 500 and casing 504 may be the same as the cover 292 and casing 280 previously described. Additionally, the artificial light source 456 may be secured within the cavity 440 of the front upright 408 by a threaded rod (not illustrated) in a threaded aperture 508 in the projection 428.

The front end 460 of the light transmission rod 452 may be inserted through the cavity 444 (through both the body 476 and neck 484), through the cutout 416, and into the cavity 440, abutting the ridge 496 and/or the artificial light source 456. In at least one example embodiment, the front end 460 of the light transmission rod 452 abuts the cover 500 for a tritium light source housed within the casing 504.

When the front end 460 of the light transmission rod 452 abuts the ridge 496, the light transmission rod 452 extends through the cutout 416, and into the neck 484 and body 476 of the cavity 444 in the rear upright 412. The retainer 448 is engaged within the body 476 of the cavity 444 in the rear upright 412. More specifically the retainer 448 is aligned along the longitudinal axis of the cavity 444. A first end, or free end, 512 is inserted into the cavity 444, and pressure is applied to a second end, or aiming point end, 516 to insert the retainer 448 into the cavity 444. As the retainer 448 is inserted into the cavity 444, the rear end 464 of the light transmission rod 452 is inserted within the support section 488. Pressure is applied to the second end 516 of the retainer 448 until the retainer is in an installed position where the ridge 468 of the retainer 448 is positioned within the channel 472 and the rear end 464 of the light transmission rod 452 is axially abutting the aiming point section 492. As the retainer 448 moves into the installed position, the sidewall 470 of the retainer 448 may slightly deform to provide clearance for the ridge 468 to slide within the cavity 444. When the ridge 468 aligns with the channel 472 in the cavity 444, the sidewall 470 may "snap" (or return) to its un-deformed, original shape.

During daylight conditions, the light transmission rod 452 is exposed to light through windows 424 along a length thereof in the cutout 416 of the base 404. Light incident on the light transmission rod 452 is absorbed (for example, by the fiber optic), transmitted along a length of the light transmission rod 452, and is emitted at the rear end 464 of the light transmission rod 452. The rear end 464 is viewable by a user through the bore 494 of the aperture 480 in the retainer 448 to thereby provide an illuminated sight point or aiming reference for alignment with a desired target.

During low light conditions, the light transmission rod 452 is exposed to artificial light at the front end 460, or axial surface, adjacent the artificial light source 456. Light incident on the front end 460, or axial surface, of the light transmission rod 452 is absorbed (for example, by the fiber optic), transmitted along a length of the light transmission rod 452, and is emitted at the rear end 464 of the light transmission rod 452. The rear end 464 is viewable by a user through the bore 494 in the aperture 480 of the retainer 448 to thereby provide an illuminated sight point or aiming reference for alignment with a desired target.

During low light conditions, the light transmission rod 452 may additionally be exposed to light along its length through the windows 424 to the cutout 416. The light incident on the light transmission rod 452 is absorbed (for example, by the fiber optic), combined with the artificial light from the artificial light source 456, transmitted along a length of the light transmission rod 452 with the artificial light, and is emitted in combination at the rear end 464 of the light transmission rod 452.

When a user desires to change out the light transmission rod 452 for any reason (for example, to change the color of the light transmission rod or to install a new light transmission rod 452), the retainer 448 may be removed from the cavity 444. For example, a tool, such as a hooked pick, may be inserted through the aperture 480 in the retainer 448 to disengage the ridge 468 from the channel 472. Disengagement of the ridge 468 from the channel 472 may disengage the axial engagement of the rear end 464 of the light transmission rod 452 from the retainer 448. The retainer 448 may then be removed from the cavity 444. Alternatively, the light transmission rod 452 may be broken and removed from the cutout 416, providing access to the first end 512 of the retainer 448 to push the retainer 448 out of the cavity 444. Alternatively, if the retainer 448 is made of a polymer (such as plastic), the retainer 448 may be broken out in pieces using any tool that will fit in the aperture 480.

With the retainer 448 completely removed from the cavity 444 in the rear upright 412, the light transmission rod 452 may be removed from the cavity 440 in the front upright 408, the cutout 416, and the cavity 444 in the rear upright 412. A new or different light transmission rod 452 may be inserted through the cavity 444 and the cutout 416, and into the cavity 440 adjacent the artificial light source 456 and/or ridge 496. For example, the light transmission rod 452 may move into engagement with the artificial light source 456, may be positioned to abut the artificial light source 456, may be positioned to abut the ridge 496, or a combination of these.

The retainer 448 may be replaced within the cavity 444 by aligning the longitudinal axis of the retainer 448 with the longitudinal axis of the cavity 444 and engaging the sidewall 470 of the retainer 448 with the cavity 444. In at least one example embodiment, the first end, or free end, 512 is inserted into the cavity 444, and pressure is applied to the second end, or aiming point end, 516 to insert the retainer 448 into the cavity 444. As the retainer 448 is inserted into the cavity 444, the rear end 464 of the light transmission rod 452 is inserted within the support section 488. Pressure is applied to the second end 516 of the retainer 448 until the retainer is in an installed position where the ridge 468 of the retainer 448 is positioned within the channel 472 and the rear end 464 of the light transmission rod 452 is axially abutting the aiming point section 492. As the retainer 448 moves into the installed position, the sidewall 470 of the retainer 448 may slightly deform to provide clearance for the ridge 468 to slide within the cavity 444. When the ridge 468 aligns with the channel 472 in the cavity 444, the sidewall 470 may "snap" (or return) to its un-deformed, original shape.

Now referring to FIGS. 16-19, at least one example embodiment of a sight 600 is illustrated. The sight 600 may be similar to the sight 18 and the sight 400. In at least one example embodiment, the sight 600 may include a base, or housing, 604. A front upright 608 and rear upright 612 may be separated by, and define, a cutout 616. The front upright 608 and rear upright 612 may be similar to front upright 408 and rear upright 412. In at least one example embodiment, the front upright 608 and rear upright 612 may be connected by beams 620 enclosing the corners of cutout 616 and defining windows, or longitudinal openings, 624 providing access to the cutout 616. In at least one example embodiment, beams 620 may be integrally formed with the front upright 608 and the rear upright 612. While the sight 600 may be illustrated and described as having beams 620, it is understood that the sight 600 may be similar to the sight 18 and may not include beams 620, but instead may have an open cutout similar to the cutout 212.

In at least one example embodiment, a projection 628 may extend from a bottom surface 632 of the base 604, opposite the front upright 608 and rear upright 612. The projection 628 may serve as a mount for firearm 14. The projection 628 may be the same as projections 428 and 232. In at least one alternative example embodiment, the projection 628 may be any shaped mount for securing the front sight 600 on the firearm 14, such as a rounded projection, a circular projection, a rectangular projection, a polygonal projection, a dovetail projection, etc.

Figure 18:
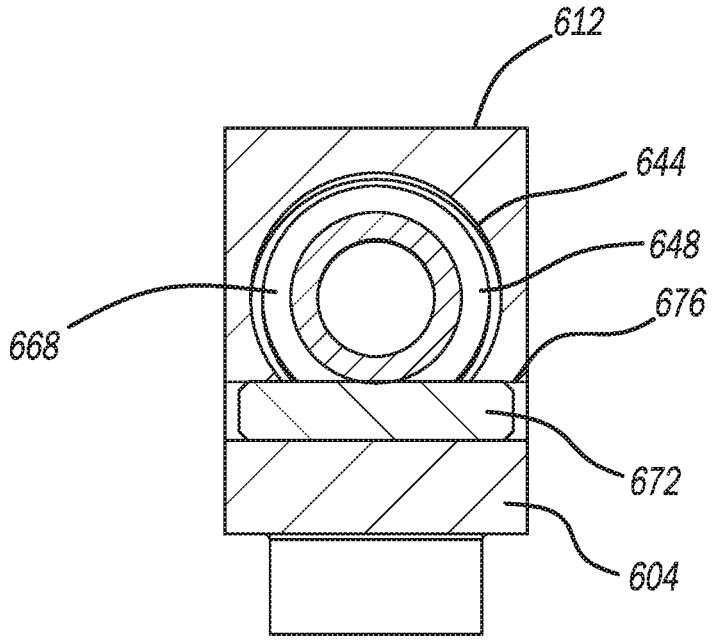
FIG. 18 is a cross sectional view of the front sight cut along arrows 18-18 in FIG. 16.
Figure 17:
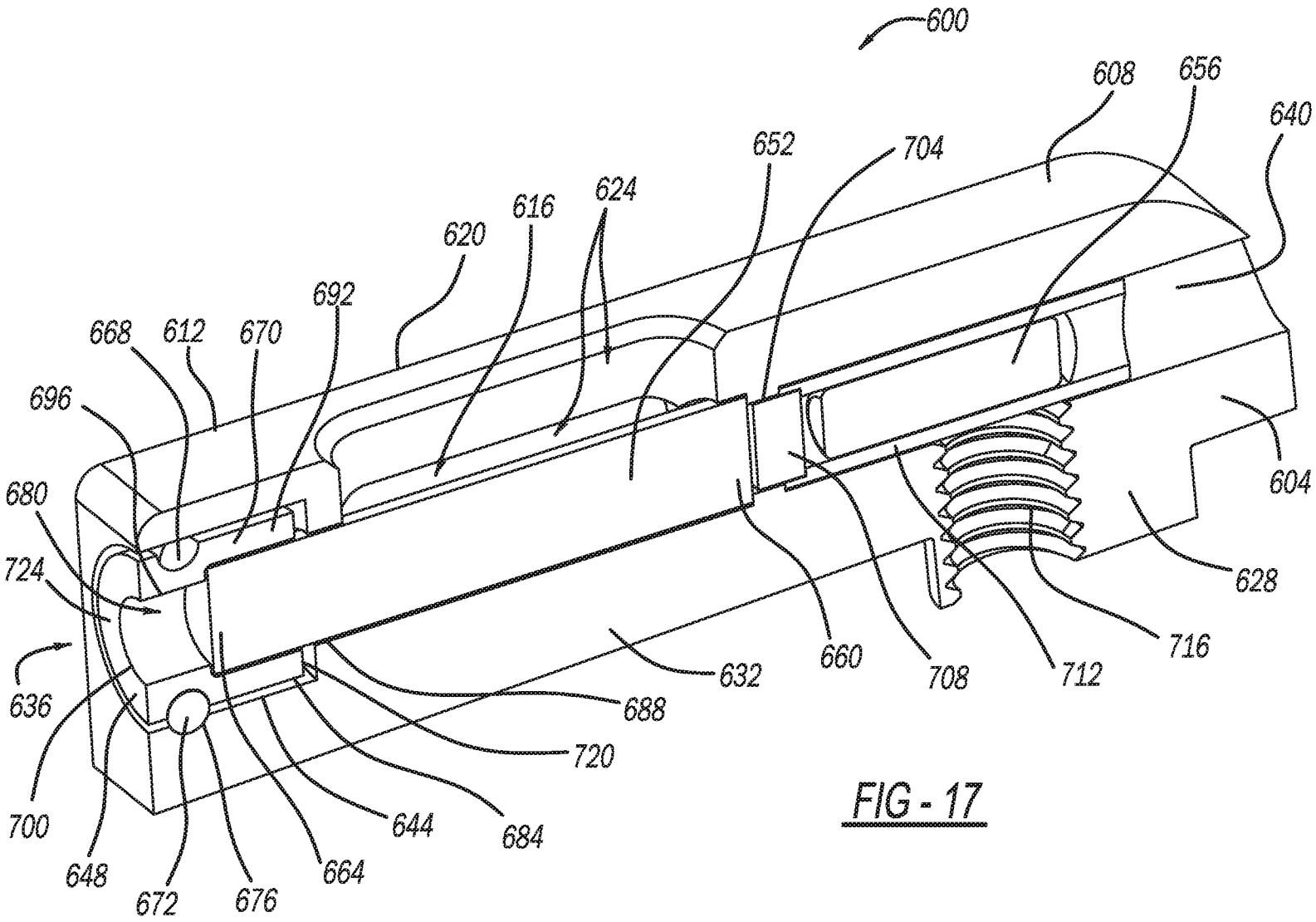
FIG. 17 is a cross sectional view of the front sight in FIG. 16, cut along a longitudinal axis of the front sight.
Figure 19:
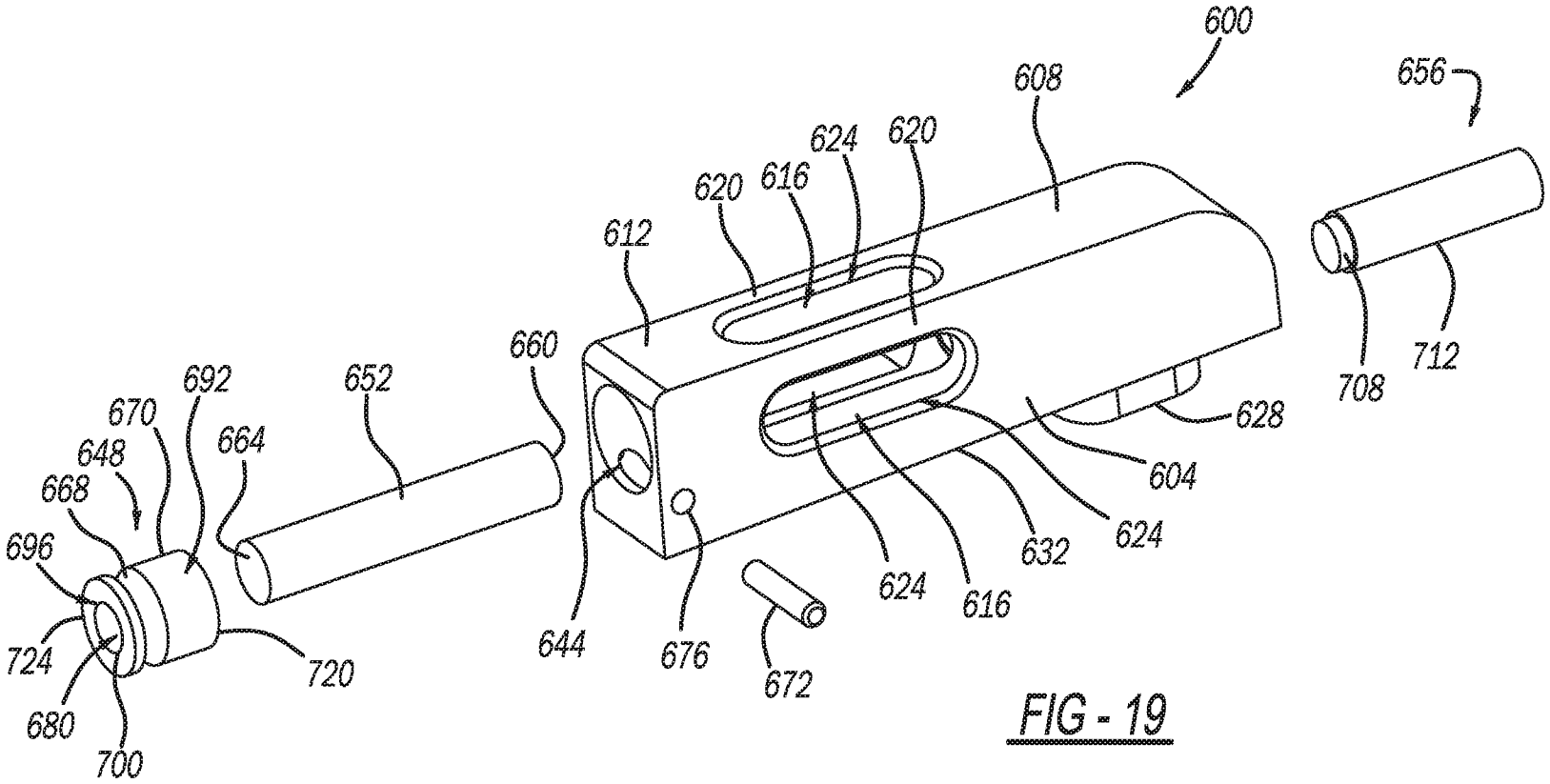
FIG. 19 is an exploded view of the front sight in FIG. 16.

Referring to FIGS. 17-19, in at least one example embodiment, an aiming reference assembly 636 may be supported within a cavity 640 in the front upright 608 and a cavity 644 in the rear upright 612. The aiming reference assembly 636 may be similar to the aiming reference assembly 252 and the aiming reference assembly 436 and may include a retainer 648, a light transmission rod 652, and an artificial light source 656. In at least one example embodiment, the cavity 640 may support the artificial light source 656 and a front end 660 of the light transmission rod 652, and the cavity 644 may support the retainer 648 and a rear end 664 of the light transmission rod 652.

In at least one example embodiment, the light transmission rod 652 may be similar to light transmission rod 228 and the light transmission rod 452. Additionally, in at least one example embodiment, the artificial light source 656 may be the same or similar to the artificial light source 260 and the artificial light source 456.

In at least one example embodiment, the retainer 648 may be configured to secure the light transmission rod 652 within the cavity 644. In at least one example embodiment, the retainer 648 may include a channel 668 in a sidewall 670 of the retainer 648. For example, the channel 668 may extend around a circumference of the sidewall. In at least one example embodiment, the channel 668 that mates or engages with a pin 672 inserted in the cavity 644 through an aperture 676 in the base 604 to secure the retainer 648 within the cavity 644. In at least one example embodiment, the retainer 648 may be a tubular retainer, having a cylindrical shape. Alternatively, it is understood that the retainer 648 is not limited to a cylindrical shape, and could have any cross sectional shape, such as an oval shape, a rectangular shape, a square shape, a triangular shape, a hexagonal shape, etc.

In at least one example embodiment, the retainer 648 may include an aperture 680 extending a length of the retainer 648 along a longitudinal axis and aligning with a longitudinal axis of the cavity 644, such that in an end view, the aperture 680 is concentric with a body 684 and a neck, or reduced diameter portion, 688 of the cavity 644. The aperture 680 may pass through a support section 692 and an aiming point section 696 in the retainer 648, where the aperture 680 in the support section 692 includes a diameter larger than a diameter of a bore 700 in the aiming point section 696. The diameter of the support section 692 of the aperture 680 may be equal to or within a range of 0 to 5% larger or smaller than a diameter of the neck 688 and equal to or slightly larger (for example, 0-2% larger) than a diameter of the light transmission rod 652, such that the light transmission rod 652 may fit within the support section 692. The diameter of the bore 700 of the aperture 680 may be less than the diameters of the support section 692, the neck 688, and the light transmission rod 652 such that the aiming point section 696 of the retainer 648 defining the bore 700 acts as a stop, preventing movement of the light transmission rod 652 outside of the cavity 644. Additionally, the bore 700 provides an exit for the light transmitted by the light transmission rod 652 and an aiming point for the sight 600.

In at least one example embodiment, the retainer 648 may be a machined metal component. Alternatively, the retainer 648 may be an injection molded polymer. For example, the injection molded retainer 648 may be manufactured at an interference fit to lock the retainer 648 within the body 684.

In at least one example embodiment, the retainer 648 may be a secondary aiming reference. For example, the retainer 648 may include a colored coating, paint, dye, colored material, etc. to distinguish the retainer 648 from the base 604 and the light transmission rod 652. Alternatively, the retainer 648 may include a colored coating, paint, dye, colored material, etc. that distinguishes the retainer 648 from the base 604 but matches the light transmission rod 652. The coating, paint, dye, material, etc., may be fluorescent, glossy, matte, any color, or include any effect that provides a secondary aiming reference for a user.

In at least one example embodiment, the light transmission rod 652 is exposed to natural light, or sunlight, through the windows 624 in the cutout 616 as the light transmission rod 652 extends between the cavity 640 in the front upright 608 and the cavity 644 in the rear upright 612.

In use, the artificial light source 656 may be secured within the cavity 640 of the front upright 608 through the engagement between a ridge (or decreased diameter portion) 704 in the cavity 640 and the artificial light source 656. More specifically, in at least one example embodiment, a cover 708 of a casing, or canister, 712 enclosing the artificial light source 656 may be supported within the ridge 704. The cover 708 and casing 712 may be the same as the cover 292 and casing 280 previously described. Additionally, the artificial light source 656 may be secured within the cavity 640 of the front upright 608 by a threaded rod (not illustrated) in a threaded aperture 716 in the projection 628.

The front end 660 of the light transmission rod 652 may be inserted through the cavity 644 (through both the body 684 and neck 688), through the cut out 616, and into the cavity 640, abutting the ridge 704 and/or the artificial light source 656. In at least one example embodiment, the front end 660 of the light transmission rod 652 abuts the cover 708 for a tritium light source housed within the casing 712.

When the front end 660 of the light transmission rod 652 abuts the ridge 704, the light transmission rod 652 extends through the cutout 616, and into the neck 688 and body 684 of the cavity 644 in the rear upright 612. The retainer 648 is then engaged within the body 684 of the cavity 644 in the rear upright 612. More specifically the retainer 648 is aligned along the longitudinal axis of the cavity 644. A first end, or free end, 720 is inserted into the cavity 644, and pressure is applied to a second end, or aiming point end, 724 to insert the retainer 648 into the cavity 644. As the retainer 648 is inserted into the cavity 644, the rear end 664 of the light transmission rod 652 is inserted within the support section 692. Pressure is applied to the second end 724 of the retainer 648 until the retainer is in an installed position where the channel 668 of the retainer 648 is positioned is aligned with the aperture 676 in the base 604 and the rear end 664 of the light transmission rod 652 is axially abutting the aiming point section 492. In at least one embodiment, the second end 724 of the retainer 648 may be flush with the base 604. The pin 672 is inserted within the aperture 676 and the channel 668 to lock the retainer 648 in the cavity 644.

During daylight conditions, the light transmission rod 652 is exposed to light through windows 624 along a length thereof in the cutout 616 of the base 604. Light incident on the light transmission rod 652 is absorbed (for example, by the fiber optic), transmitted along a length of the light transmission rod 652, and is emitted at the rear end 664 of the light transmission rod 652. The rear end 664 is viewable by a user through the bore 700 of the aperture 680 in the retainer 648 to thereby provide an illuminated sight point or aiming reference for alignment with a desired target.

During low light conditions, the light transmission rod 652 is exposed to artificial light at the front end 660, or axial surface, adjacent the artificial light source 656. Light incident on the front end 660, or axial surface, of the light transmission rod 652 is absorbed (for example, by the fiber optic), transmitted along a length of the light transmission rod 652, and is emitted at the rear end 664 of the light transmission rod 652. The rear end 664 is viewable by a user through the bore 700 in the aperture 680 of the retainer 648 to thereby provide an illuminated sight point or aiming reference for alignment with a desired target.

During low light conditions, the light transmission rod 652 may additionally be exposed to light along its length through the windows 624 to the cutout 616. The light incident on the light transmission rod 652 is absorbed (for example, by the fiber optic), combined with the artificial light from the artificial light source 656, transmitted along a length of the light transmission rod 652 with the artificial light, and is emitted in combination at the rear end 664 of the light transmission rod 652.

When a user desires to change out the light transmission rod 652 for any reason (for example, to change the color of the light transmission rod or to install a new light transmission rod 652), the retainer 648 may be removed from the cavity 644. In at least one example embodiment, the pin 672 is removed from the channel 668 and the aperture 676 in the base 604. For example, a tool, such as a pin punch or pusher tool, is used to press the pin 672 out of the channel 668 and the aperture 676 in the base 604. Removal of the pin 372 subsequently frees the retainer 648. Axial movement of the retainer 648 away from the light transmission rod 652 disengages the axial engagement between the retainer 648 and the rear end 664 of the light transmission rod 652. The retainer 648 may then be disengaged from the cavity 644.

With the retainer 648 completely removed from the cavity 644 in the rear upright 612, the light transmission rod 652 may be removed from the cavity 640 in the front upright 608, the cutout 616, and the cavity 644 in the rear upright 612. A new or different light transmission rod 652 may be inserted through the cavity 644 and the cutout 616, and into the cavity 640 adjacent the artificial light source 656 and/or ridge 704. For example, the light transmission rod 452 may move into engagement with the artificial light source 656, may be positioned to abut the artificial light source 656, may be positioned to abut the ridge 704, or a combination of these.

The retainer 648 may be replaced within the cavity 644 by aligning the longitudinal axis of the retainer 648 with the longitudinal axis of the cavity 644 and engaging the sidewall 670 of the retainer 648 with the cavity 644. In at least one example embodiment, the first end, or free end, 720 is inserted into the cavity 644, and pressure is applied to a second end, or aiming point end, 724 to insert the retainer 648 into the cavity 644. As the retainer 648 is inserted into the cavity 644, the rear end 664 of the light transmission rod 652 is inserted within the support section 692. Pressure is applied to the second end 724 of the retainer 648 until the retainer is in an installed position where the channel 668 of the retainer 648 is positioned is aligned with the aperture 676 in the base 604 and the rear end 664 of the light transmission rod 652 is abutting the aiming point section 492. In at least one embodiment, the second end 724 of the retainer 648 may be flush with the base 604. The pin 672 is inserted within the aperture 676 and the channel 668 to lock the retainer 648 in the cavity 644.

Figure 20:
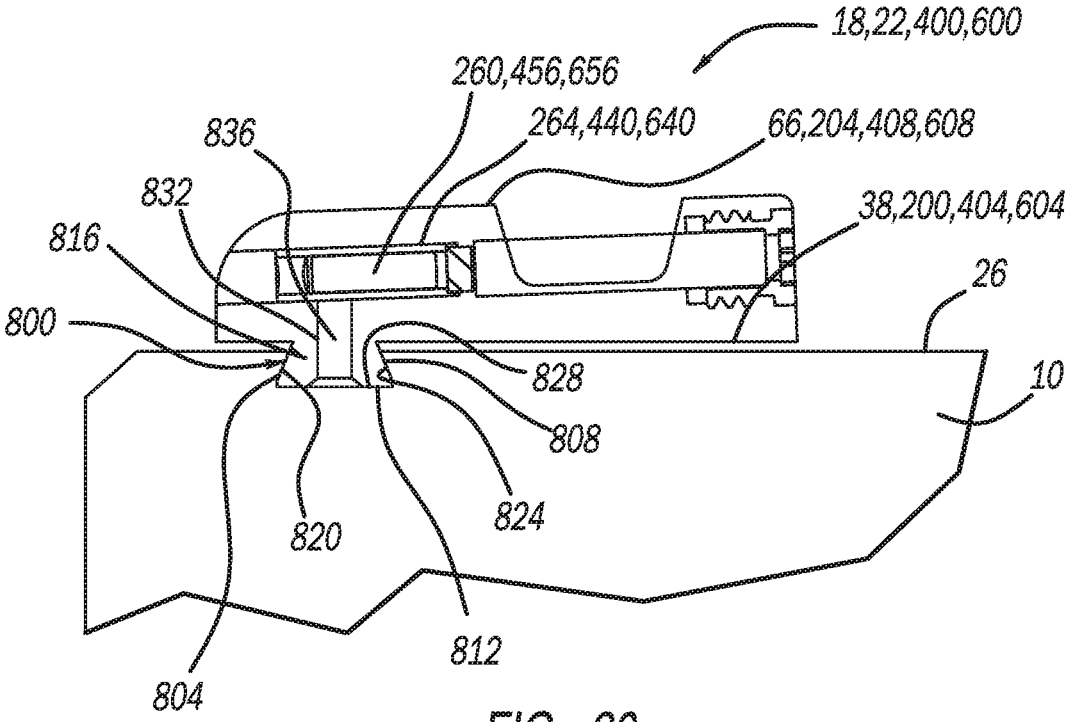
FIG. 20 is a section view of a cross sectional view cut along a longitudinal axis of at least one example embodiment of a firearm having a sight with a dovetail mount.

Now referring to FIG. 20 in conjunction with FIGS. 2-7, the sight 18, 22, 400, 600 may be mounted on slide 26 of firearm 14 by projection 58, 232, 428, 628. In at least one example embodiment, the projection 58, 232, 428, 628 may be a dovetail mount 800, as illustrated in FIG. 20. Dovetail mount 800 may be the same as projection, or firearm mount, 58 and may include a trapezoidal cross section having a sloped front face 804 and a sloped rear face 808 that converge as they approach the base 38, 200, 404, 604 of the sight 18, 22, 400, 600. The dovetail mount 800 may also include a bottom surface 812 connecting the front face 804 and the rear face 808 and extending parallel with the bottom surface 54, 236, 432, 632 of the base 38, 200, 404, 604.

In at least one example embodiment, the dovetail mount 800 may engage with a mating sight mount 816 on the slide 26 of the firearm 14. The sight mount 816 may be a recess in the slide 26 and may include a sloped front face 820, a sloped rear face 824, and a bottom surface 828 that connects the front face 820 and the rear face 824. The front face 820 and the rear face 824 are sloped such that they diverge as they approach the bottom surface 828. In at least one example embodiment, the slope of the front face 820 matches the slope of the front face 804 of the dovetail mount 800, and the slope of the rear face 824 matches the slope of the rear face 808 of the dovetail mount 800.

In at least one example embodiment, the dovetail mount 800 may include an aperture 832 extending from the bottom surface 812 to the cavity 264, 440, 640 in the front upright 66, 204, 408, 608. The aperture 832 may be the same as apertures 244, 508, and 716. The aperture 832 may receive a rod 836 to secure a position of the artificial light source 260, 456, 656 in the cavity 264, 440, 640. For example, if the artificial light source 260, 456, 656 is a non-radioluminescent light source, the rod 836 may secure the artificial light source 260, 456, 656 in the cavity 264, 440, 640. For example, the aperture 832 may be a threaded aperture and the rod 836 may be a threaded rod. Alternatively, the aperture 832 may not be threaded, and the rod 836 may be a pin that is compressed against the artificial light source 260, 456, 656. The rod 836 may be fixed within the aperture 832 by gap filling retention compounds and/or adhesive materials. Alternatively, the aperture 832 may provide access for additional adhesive application during assembly. For example, adhesive materials and/or gap filling retention compounds may be applied in the cavity 264, 440, 640 through the aperture 832 to secure the artificial light source 260 in the cavity 264, 440, 640.

In use, with the sight 18, 22, 400, 600 disassembled from the firearm 14, the rod 836 is inserted within the aperture 832, by engaging threads or otherwise, to secure the artificial light source 260, 456, 656 within the cavity 264, 440, 640. A longitudinal axis of the dovetail mount 800 on the sight 18, 22, 400, 600 is aligned along a longitudinal axis of the sight mount 816 on the slide 26 of the firearm 14 such that a front face 804 of the dovetail mount 800 aligns with the front face 820 of the sight mount 816, the rear face 808 of the dovetail mount 800 aligns with the front face 824 of the sight mount 816, and the bottom surface 812 of the dovetail mount 800 aligns with the bottom surface 828 of the sight mount 816.

In at least one example embodiment, the sight 18, 22, 400, 600 is moved laterally along the longitudinal axis of the sight mount 816. The sight 18, 22, 400, 600 is moved laterally until the bottom surface 812 of the dovetail mount 800 is completely aligned and engaged with the bottom surface 828 of the sight mount 816. When the bottom surface 812 is completely aligned with the bottom surface 828, a perimeter of the bottom surface 812 engages with a perimeter of the bottom surface 828.

In at least one example embodiment, to remove the sight 18, 22, 400, 600 from the firearm 14, the sight 18, 22, 400, 600 is moved laterally until the bottom surface 812 of the dovetail mount 800 is completely disengaged with the bottom surface 828 of the sight mount 816.

Figure 21:
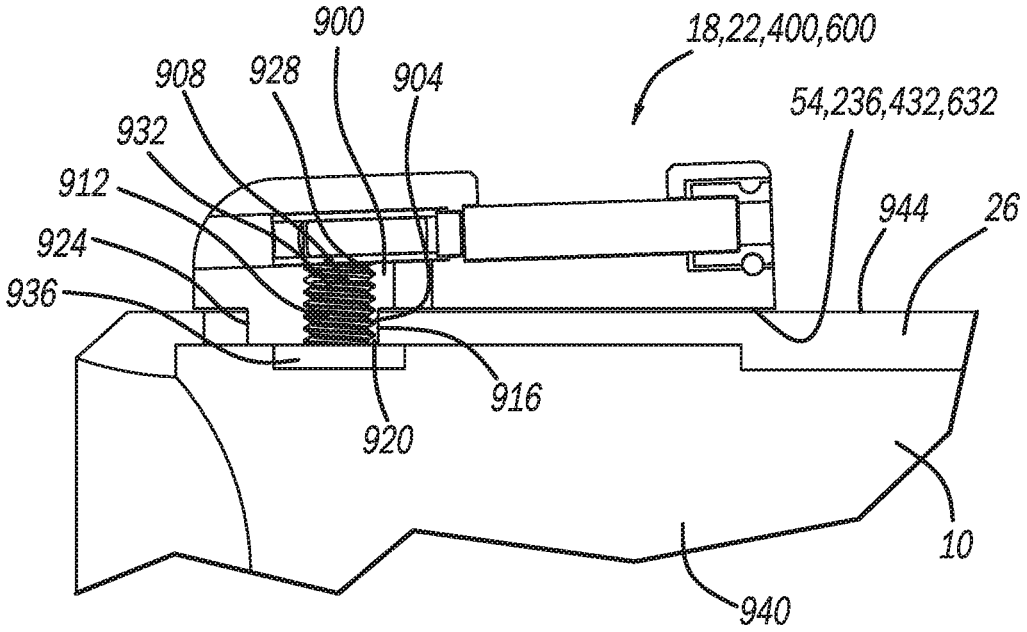
FIG. 21 is a section view of a cross sectional view cut along a longitudinal axis of at least one example embodiment of a firearm having a sight with a projection mount.

Now referring to FIG. 21 in conjunction with FIGS. 8-19, the sight 18, 22, 400, 600 may be mounted on slide 26 of firearm 14 by the projection 58, 232, 428, 628. In at least one example embodiment, the projection 58, 232, 428, 628 may be a projection mount 900, as illustrated in FIG. 21. Projection mount 900 may be the same as projection, or firearm mount, 232, 428, 628 and may include an oval-shaped projection 904. While the projection 904 is illustrated and described as an oval-shaped projection 904, the projection 904 may be any shaped mount for securing the sight 18, 22, 400, 600 on the firearm 14, such as a rounded projection, a circular projection, a rectangular projection, a polygonal projection, etc. In at least one example embodiment, the projection 904 may include an aperture 908 configured to engage a rod 912 and secure the sight 18, 22, 400, 600 on the firearm 14.

In at least one example embodiment, the projection 904 may fit within an aperture 916 in slide 26. For example, the aperture 916 may be an oval-shaped aperture (or any shaped aperture that mates with a shape of the projection) having sidewalls 920 that engage with sidewalls 924 of the projection 904. The engagement of the oval shape of the sidewalls 924 of the projection 904 with the sidewalls 920 of the aperture 916 may properly or correctly position the sight 18, 22, 400, 600 relative to the slide 26 on the firearm 14.

In at least one example embodiment, the aperture 908 in the projection 904 may include threads 928 for engaging threads 932 on the rod 912 to secure the rod 912 in the aperture 908. Alternatively, the aperture 908 and the rod 912 may not include threads, and the rod 912 may be press fit within the aperture 908. Alternatively, the rod 912 may be fixed within the aperture 908 by gap filling retention compounds and/or adhesive materials. In at least one example embodiment, the aperture 908 may provide access for additional adhesive application during assembly. For example, adhesive materials and/or gap filling retention compounds may be applied in the cavity 264, 440, 640 through the aperture 908 to secure the artificial light source 260 in the cavity 264, 440, 640.

In at least one example embodiment, the rod 912 may include a base 936 integrally formed with the rod 912. In at least one example embodiment, a diameter of the base 936 may be larger than a diameter of the rod 912. When assembled, the base 936 may be positioned between the slide 26 and a body 940 of the firearm 14 and the rod 912 may extend through the aperture 916 in the slide 26. Thus, the base 936 and rod 912 remain secured to the firearm 14.

In use, with the sight 18, 22, 400, 600 disassembled from the firearm 14, the base 936 is secured between the slide 26 and the body 940 of the firearm 14 with the rod 912 extending through the aperture 916 in the slide 26. In at least one example embodiment, a rotation axis through the aperture 908 in the projection 904 is aligned with a rotation axis through the rod 912. The rod 912 is inserted within the aperture 908 and rotated to engage the threads 928 on the rod 912 with the threads 932 in the aperture 908.

In at least one example embodiment, as the threads 928 on the rod 912 are engaged with the threads 932 in the aperture 908, the projection 904 is inserted within the aperture 916 in the slide 26. Accordingly, the sidewall 924 of the projection 904 becomes engaged with the sidewall 920 of the aperture 916. In at least one example embodiment, the rod 912 is rotated until the sight 18, 22, 400, 600 is fully installed on the firearm, and the bottom surface 54, 236, 432, 632 is seated on a top surface 944 of the slide 26.

In at least one example embodiment, to remove the sight 18, 22, 400, 600 from the firearm 14, the sight 18, 22, 400, 600 is rotated to rotate the rod 912 until the bottom surface 54, 236, 432, 632 of the sight 18, 22, 400, 600 is completely disengaged from the top surface 944 of the slide 26. The rod 912 is further rotated (either by rotating the sight 18, 22, 400, 600 or by other means) until the rod 912 is disengaged from the aperture 908 in the projection 904.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A sight for a firearm comprising:

a housing configured to be mounted to a firearm, the housing defining a first cavity and a second cavity separated by a ridge in a sidewall of the first cavity;

a tritium light source supported within the first cavity in the housing, the ridge defining a stop to position the tritium light source within the first cavity;

a light transmission rod disposed in the second cavity of the housing and positioned adjacent the tritium light source, the ridge defining the stop to position the light transmission rod adjacent the tritium light source, the light transmission rod being configured to collect and transmit both an ambient light and a light from the tritium light source; and a retainer removably engaged with the housing and fixing the light transmission rod against the ridge and within the second cavity, wherein removal of the retainer provides access to the second cavity for replacement of the light transmission rod.

2. The sight of claim 1, wherein the tritium light source illuminates an axial surface of the light transmission rod.

3. The sight of claim 1, wherein the light transmission rod is a fiber optic rod.

4. The sight of claim 1, wherein the retainer is press-fit within the second cavity in the housing.

5. The sight of claim 1, wherein the retainer includes threads that threadingly engage an inner surface of the second cavity in the housing.

6. The sight of claim 5, further comprising a polymer patch on the threads of the retainer.

7. The sight of claim 1, wherein the light transmission rod is axially abutted by the retainer such that after the retainer is removed from the housing, the light transmission rod is slidably removable from the second cavity.

8. The sight of claim 1, wherein the retainer defines an axially extending aperture, and the light transmission rod is aligned with the axially extending aperture to provide an aiming reference.

9. The sight of claim 8, wherein an exterior axial end surface of the retainer includes a colored coating or paint to provide a secondary aiming reference.

10. The sight of claim 1, wherein the housing includes a longitudinal opening into the second cavity, the longitudinal opening exposing at least a top half of the light transmission rod.

11. The sight of claim 1, wherein an outside surface of the retainer includes a tool interface.

12. A sight for a firearm comprising:

a housing configured to be mounted to a firearm, the housing having a first cavity and a second cavity separated by a ridge in a sidewall of the first cavity;

an artificial light source disposed within the first cavity of the housing, the ridge defining a stop to position the artificial light source within the first cavity;

a light transmission rod positioned in the second cavity of the housing, positioned adjacent the artificial light source, and axially coupled to illumination from the artificial light source, the ridge defining the stop to position the light transmission rod adjacent the artificial light source, the light transmission rod being configured to collect and transmit both ambient light and light from the artificial light source; and a retainer removably engaged with the housing and fixing the light transmission rod against the ridge and within the second cavity, wherein removal of the retainer provides access to the second cavity for replacement of the light transmission rod.

13. The sight of claim 12, wherein the artificial light source is a tritium lamp.

14. The sight of claim 12, wherein the artificial light source is a light emitting diode.

15. The sight of claim 12, wherein the light transmission rod is a fiber optic rod.

16. The sight of claim 12, wherein the retainer includes threads that threadingly engage an inner surface of the second cavity in the housing or the retainer is press-fit within the second cavity in the housing.

17. The sight of claim 12, wherein the light transmission rod is axially abutted by the retainer such that after the retainer is removed from the housing, the light transmission rod is slidably removable from the second cavity.

18. The sight of claim 12, wherein an outside surface of the retainer includes a tool interface.

19. The sight of claim 18, wherein the tool interface is one of a hex, a square, a phillips, a cross, a star, a torx, a flathead, a slotted, or a spanner.

20. A sight for a firearm comprising:

a housing configured to be mounted to a firearm, the housing defining a first cavity and a second cavity separated by a ridge in a sidewall of the first cavity;

an artificial light source disposed within the first cavity in the housing, the ridge defining a stop to position the artificial light source within the first cavity;

a light transmission rod positioned in the second cavity in the housing, the ridge defining the stop to position the light transmission rod adjacent the artificial light source, the light transmission rod being configured to collect and transmit both ambient light and light from the artificial light source; and a retainer threadably engaged with the housing and fixing the light transmission rod against the ridge and within the second cavity of the housing, the retainer defining an axially extending aperture that aligns with the light transmission rod to provide an aiming reference, wherein removal of the retainer provides access to the second cavity for replacement of the light transmission rod.

* * * * *